US009382656B2

(12) United States Patent
Lee et al.

(10) Patent No.: US 9,382,656 B2
(45) Date of Patent: Jul. 5, 2016

(54) LAUNDRY TREATING APPARATUS

(71) Applicant: LG ELECTRONICS INC., Seoul (KR)

(72) Inventors: Youngjoo Lee, Seoul (KR); Jongseok Kim, Seoul (KR); Daeyun Park, Seoul (KR); Sungmin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 482 days.

(21) Appl. No.: 13/768,064

(22) Filed: Feb. 15, 2013

(65) Prior Publication Data

US 2013/0334939 A1 Dec. 19, 2013

(30) Foreign Application Priority Data

| | | |
|---|---|---|
| Feb. 16, 2012 | (KR) | 10-2012-0015959 |
| Feb. 16, 2012 | (KR) | 10-2012-0015960 |
| Feb. 16, 2012 | (KR) | 10-2012-0015961 |
| Feb. 16, 2012 | (KR) | 10-2012-0015962 |
| Feb. 16, 2012 | (KR) | 10-2012-0015963 |
| Feb. 16, 2012 | (KR) | 10-2012-0015964 |
| Feb. 16, 2012 | (KR) | 10-2012-0015965 |
| Feb. 16, 2012 | (KR) | 10-2012-0015966 |
| Feb. 16, 2012 | (KR) | 10-2012-0015967 |

(51) Int. Cl.

| | |
|---|---|
| ***D06F 39/12*** | (2006.01) |
| ***D06F 58/06*** | (2006.01) |
| ***D06F 37/22*** | (2006.01) |
| ***F26B 21/00*** | (2006.01) |

(Continued)

(52) U.S. Cl.

CPC ..... *D06F 39/12* (2013.01); *D06F 37/22* (2013.01); *D06F 58/06* (2013.01); *D06F 58/08* (2013.01); *F26B 21/003* (2013.01); *F26B 21/086* (2013.01); *F26B 25/16* (2013.01); *D06F 58/04* (2013.01); *D06F 58/20* (2013.01)

(58) Field of Classification Search

CPC ..... D06F 37/22; D06F 39/12; D06F 58/04; D06F 58/06; D06F 58/08; D06F 58/20

See application file for complete search history.

(56) References Cited

U.S. PATENT DOCUMENTS

| | | | | |
|---|---|---|---|---|
| 4,007,546 A * | 2/1977 | Sauer | D06F 58/04 34/242 |
| 5,127,169 A | 7/1992 | Ellingson | 34/133 |

(Continued)

FOREIGN PATENT DOCUMENTS

| | | |
|---|---|---|
| CN | 1637202 A | 7/2005 |
| EP | 0 112 138 A1 | 6/1984 |

(Continued)

OTHER PUBLICATIONS

United States Office Action dated Jun. 26, 2015 issued in U.S. Appl. No. 13/768,088.

(Continued)

*Primary Examiner* — Joseph L Perrin

(74) *Attorney, Agent, or Firm* — Ked & Associates, LLP

(57) ABSTRACT

The present invention relates to a laundry treating apparatus that smoothly agitates laundry with as large space as possible for receiving laundry. The laundry treating apparatus includes: a rotatable drum that receives laundry, has open front and rear, and is formed to have a non-circular closed cross-section; a rotatable circular guide that supports a portion having a uniform curvature of the drum; and a drum guide that is disposed on the edge of the drum and seals the portion between the circular guide and the drum.

20 Claims, 19 Drawing Sheets

(51) Int. Cl.

| | |
|---|---|
| ***F26B 21/08*** | (2006.01) |
| ***F26B 25/16*** | (2006.01) |
| ***D06F 58/08*** | (2006.01) |
| *D06F 58/04* | (2006.01) |
| *D06F 58/20* | (2006.01) |

(56) References Cited

U.S. PATENT DOCUMENTS

| | | | | |
|---|---|---|---|---|
| 7,194,824 | B2 | 3/2007 | Wang | |
| 2005/0132603 | A1 | 6/2005 | Jeong et al. | |
| 2005/0252254 | A1 | 11/2005 | Kim | 68/142 |
| 2009/0113743 | A1 | 5/2009 | Kim | 34/132 |
| 2009/0158616 | A1 | 6/2009 | Ricklefs et al. | 34/601 |
| 2009/0158617 | A1 | 6/2009 | Ricklefs et al. | |
| 2010/0206016 | A1 | 8/2010 | Bae et al. | 68/5 |
| 2011/0072680 | A1* | 3/2011 | Kim | D06F 37/02 34/108 |
| 2011/0072681 | A1 | 3/2011 | Kim et al. | 34/108 |
| 2011/0232336 | A1* | 9/2011 | Hong | D06F 37/04 68/140 |
| 2011/0258872 | A1* | 10/2011 | Kim | D06F 37/02 34/85 |
| 2011/0296878 | A1 | 12/2011 | Moon et al. | 68/140 |
| 2012/0067088 | A1 | 3/2012 | Hong | |

FOREIGN PATENT DOCUMENTS

| | | | |
|---|---|---|---|
| JP | 2006-075417 | A | 3/2006 |
| KR | 20-1988-0000690 | Y1 | 3/1988 |
| KR | 10-2004-0006238 | A | 1/2004 |
| KR | 10-2005-0037186 | A | 4/2005 |
| KR | 10-2005-0062017 | A | 6/2005 |
| KR | 10-0619728 | B1 | 9/2006 |
| KR | 10-0784713 | B1 | 12/2007 |
| KR | 10-1003353 | B1 | 12/2010 |
| KR | 10-2011-0048848 | A | 5/2011 |
| WO | WO 2006/120644 | A1 | 11/2006 |
| WO | WO 2008/010670 | A2 | 1/2008 |
| WO | WO 2011/105829 | A2 | 9/2011 |

OTHER PUBLICATIONS

International Search Report dated May 24, 2013 issued in Application No. PCT/KR2013/001206.

International Search Report dated May 24, 2013 issued in Application No. PCT/KR2013/001213.

International Search Report dated Jun. 11, 2013 issued in Application No. PCT/KR2013/001212.

International Search Report dated Jun. 25, 2013 issued in Application No. PCT/KR2013/001210.

European Search Report dated Jul. 9, 2015 issued in Application No. 13748931.6.

European Search Report dated Jul. 7, 2015 issued in Application No. 13748961.3.

European Search Report dated Jul. 7, 2015 issued in Application No. 13749528.9.

European Search Report dated Jul. 7, 2015 issued in Application No. 13749936.4.

U.S. Office Action issued in co-pending U.S. Appl. No. 13/768,073 dated Jan. 5, 2016.

U.S. Final Office Action issued in co-pending U.S. Appl. No. 13/768,088 dated Feb. 2, 2016.

Chinese Office Action Issued in Appheation No. 201380020158.9 dated Feb. 1, 2016.

U.S. Office Action issued in co-pending U.S. Appl. No. 13/768,088 dated May 13, 2016.

* cited by examiner (a)

(b)

LAUNDRY TREATING APPARATUS

BACKGROUND OF THE INVENTION

1. Field of the Invention

The present invention relates to a laundry treating apparatus, and more particularly, a laundry treating apparatus that has a space as large as possible for receiving laundry and in which laundry is smoothly moved.

2. Description of the Related Art

Laundry treating apparatuses mean all of the apparatuses that handle or treat clothes and bedclothes (hereafter, referred to as 'laundry') such as washing, drying, and smoothing of laundry at home or laundries. As the laundry treating apparatuses, there are a washing machine that removes contaminants from laundry, using chemical decomposition between water and a detergent and physical actions between water and the laundry, a drying machine that dries wet laundry by spinning the laundry, and a refresher that prevents allergy due to laundry and simply wash laundry by ejecting heated vapor to the laundry.

The drying machine is an appliance that dries usually washed laundry, using high-temperature air. Drying machines are generally equipped with a drum that receives laundry and rotates. High-temperature dry air is supplied into a drum rotating with a laundry therein and the wet air in the drum is discharged. However, there is a problem in that it is difficult to secure a maximum space for the drum, because the drum can rotated in the drying machine.

SUMMARY OF THE INVENTION

An object of the present invention is to provide a laundry treating apparatus that secures as large space as possible for receiving laundry and smoothly agitates laundry therein.

The objects of the present invention are not limited to those described above and other objects may be made apparent to those skilled in the art from claims.

In order to achieve the objects, a laundry treating apparatus according to an exemplary embodiment of the present invention includes: a rotatable drum that receives laundry, has open front and rear, and is formed to have a non-circular closed cross-section; a rotatable circular guide that supports a portion having a uniform curvature of the drum; and a drum guide that is disposed on the edge of the drum and seals the portion between the circular guide and the drum.

In order to achieve the objects, a laundry treating apparatus according to an exemplary embodiment of the present invention includes: a rotatable drum that receives laundry, has open front and rear, and is formed to have a non-circular closed cross-section; a rotatable upper circular guide that is disposed with the rotational center higher than the rotational center of the drum and supports a portion having a uniform curvature at the upper portion of the drum; a rotatable lower circular guide that is disposed with the rotational center lower than the rotational center of the drum and supports a portion having a uniform curvature at the lower portion of the drum; and a drum guide that is disposed at the edge of the drum in partial contact with the outer side and a side of the upper circular guide and in contact with the outer side of the lower circular guide.

The details of other exemplary embodiments are included in the following detailed description and the accompanying drawings.

DETAILED DESCRIPTION OF THE EMBODIMENT

Figure 1:
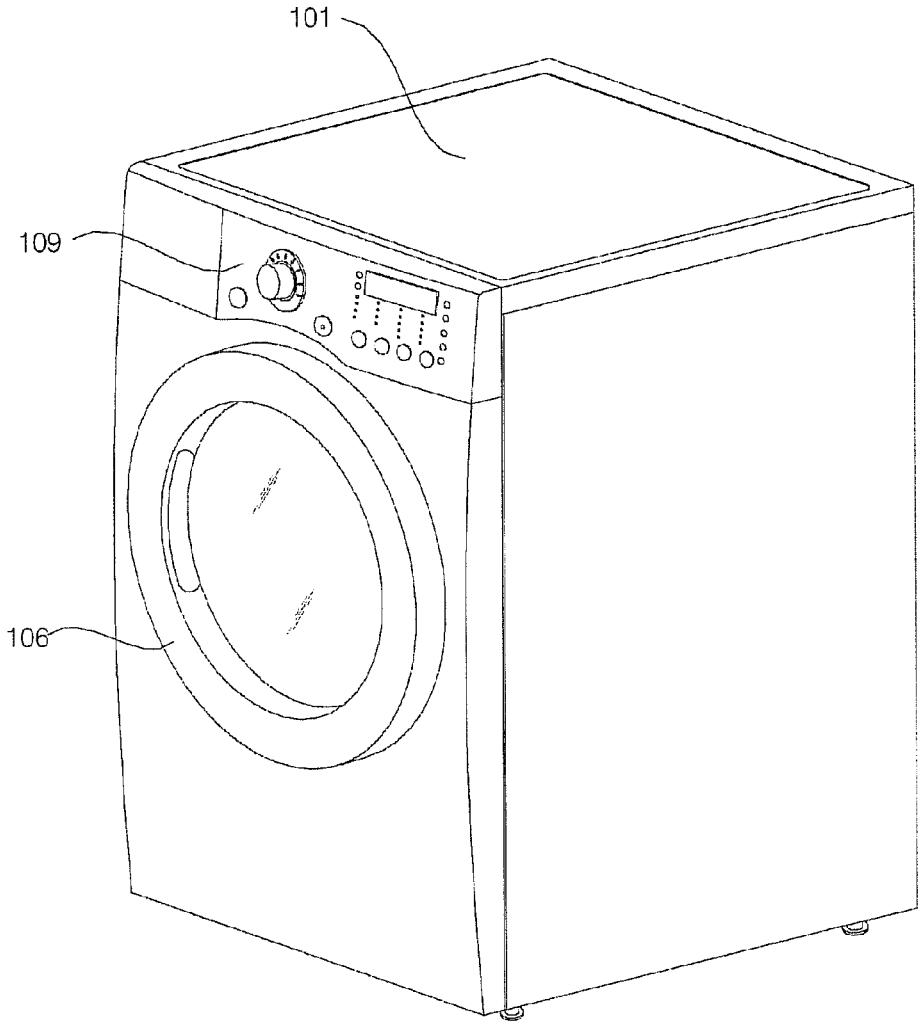
FIG. 1 is a perspective view of a laundry treating apparatus according to an exemplary embodiment of the present invention.

The advantages and features of the present invention, and methods of achieving them will be clear by referring to the exemplary embodiments that will be describe hereafter in detail with reference to the accompanying drawings. However, the present invention is not limited to the exemplary embodiments described hereafter and may be implemented in various ways, and the exemplary embodiments are provided to complete the description of the present invention and let those skilled in the art completely know the scope of the present invention and the present invention is defined by claims. Like reference numerals indicate like components throughout the specification.

Hereinafter, laundry treating apparatus according to exemplary embodiments of the present invention will be described with reference to the accompanying drawings.

Figure 2:
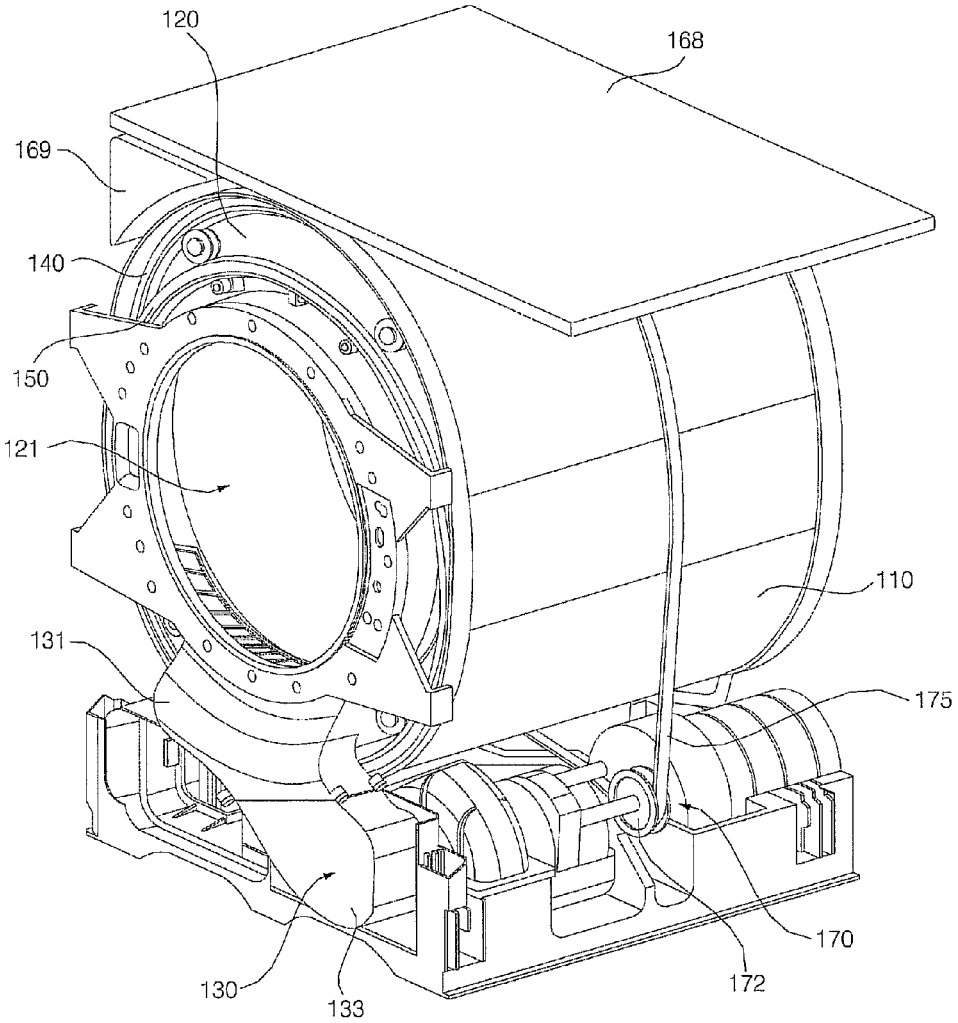
FIG. 2 is a perspective view showing the inside of the laundry treating apparatus according to an exemplary embodiment of the present invention.
Figure 3:
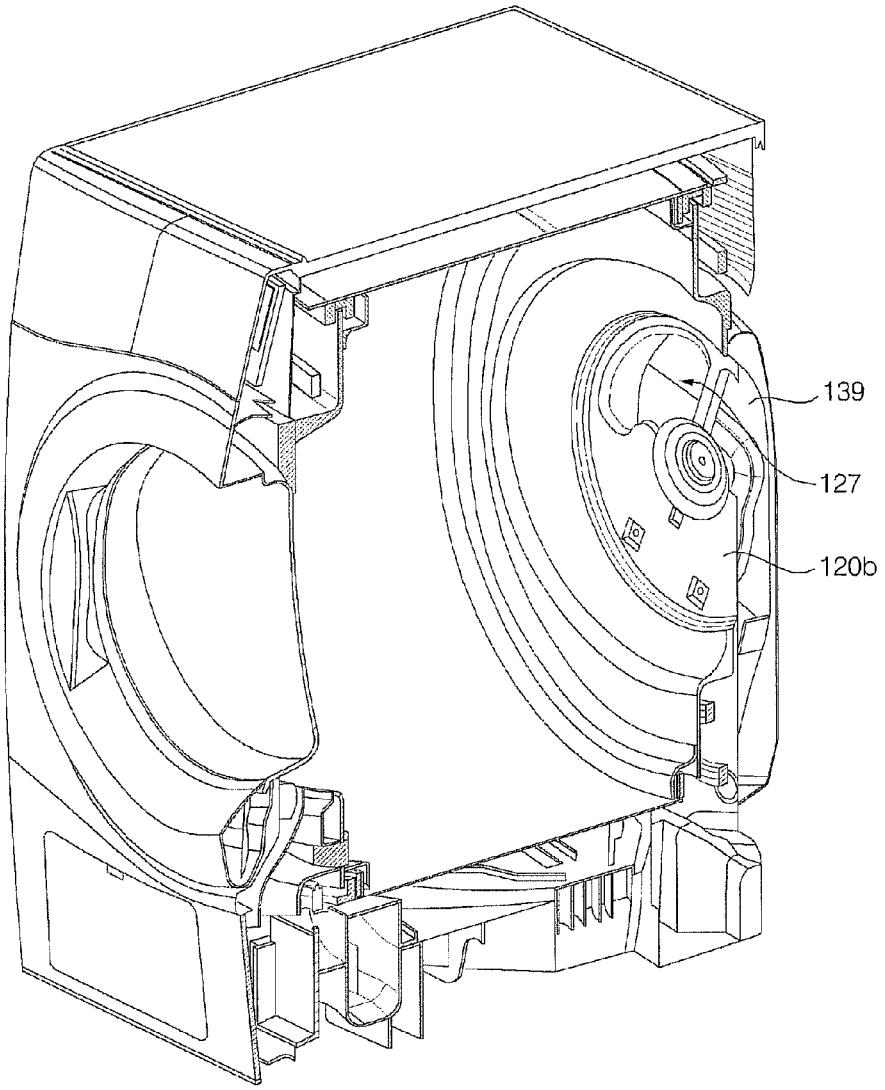
FIG. 3 is a partial cross-sectional view of the laundry treating apparatus according to an exemplary embodiment of the present invention.
Figure 4:
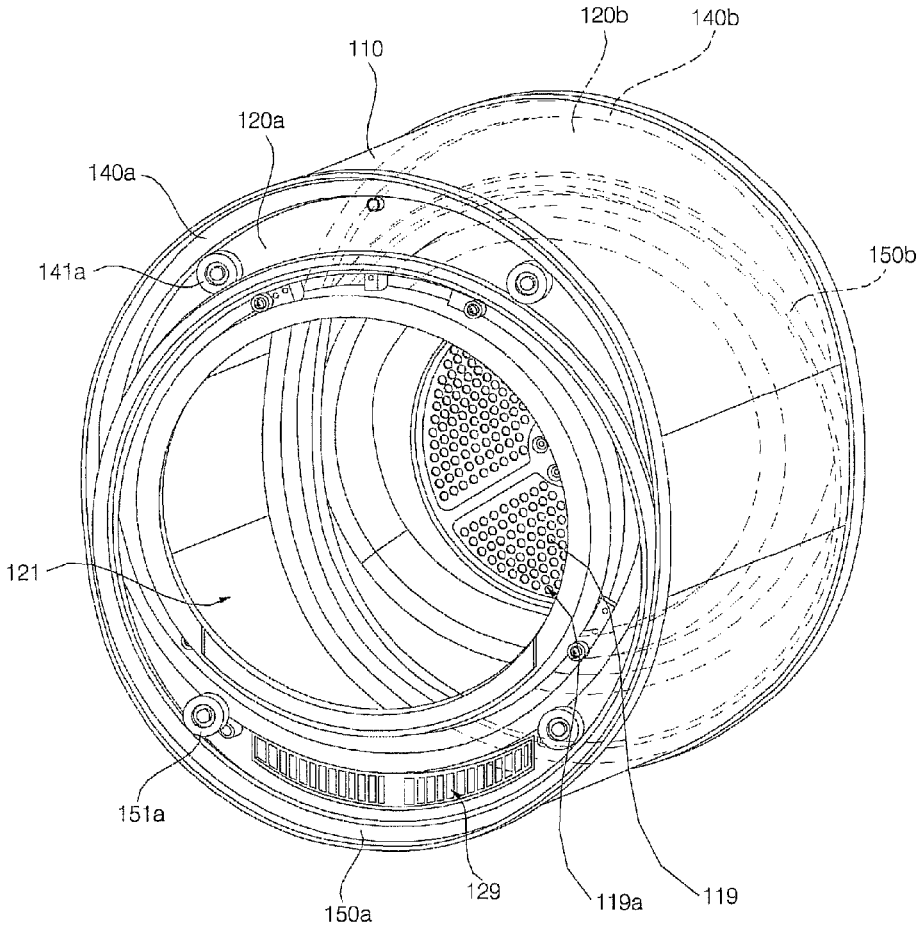
FIG. 4 is a partial perspective view showing arrangement of a circular guide of the laundry treating apparatus according to an exemplary embodiment of the present invention.
Figure 5:
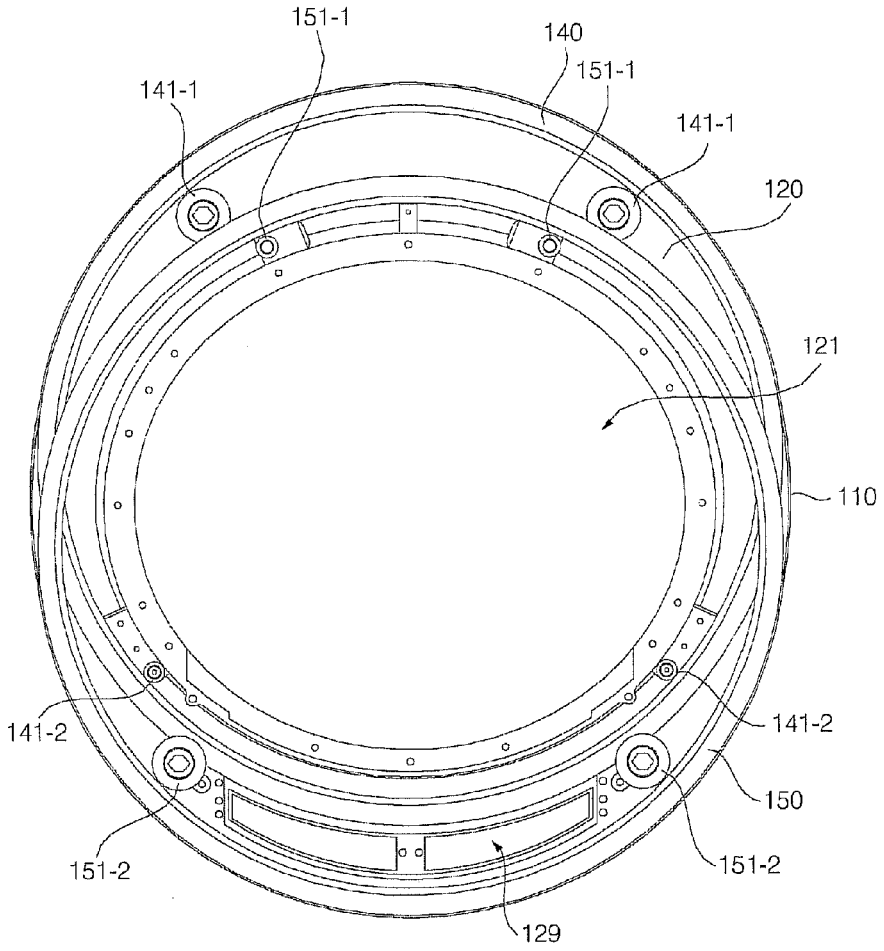
FIG. 5 is a partial front view showing arrangement of the circular guide of the laundry treating apparatus according to an exemplary embodiment of the present invention.

FIG. 1 is a perspective view of a laundry treating apparatus according to an exemplary embodiment of the present invention. FIG. 2 is a perspective view showing the inside of the laundry treating apparatus according to an exemplary embodiment of the present invention. FIG. 3 is a partial cross-sectional view of the laundry treating apparatus according to an exemplary embodiment of the present invention. FIG. 4 is a partial perspective view showing arrangement of a circular guide of the laundry treating apparatus according to an exemplary embodiment of the present invention. FIG. 5 is a partial front view showing arrangement of the circular guide of the laundry treating apparatus according to an exemplary embodiment of the present invention.

A laundry treating apparatus according to an exemplary embodiment of the present invention includes a cabinet 101 forming the external appearance, a rotatable drum 110 disposed in the cabinet 101 and receiving laundry, a rotatable upper circular guide 140 supporting a portion having a uniform curvature at the upper portion of the drum 110, and a rotatable lower circular guide 150 supporting a portion having a uniform curvature at the lower portion of the drum 110.

The cabinet 101, form the external appearance of the laundry treating apparatus, has a cabinet hole for putting/taking laundry into/out of the drum 110 at the front and a door 106 for opening/closing the cabinet hole is pivotably connected to the cabinet 101. A control panel 109 allowing a user to input operational instructions or displaying the operational status of the laundry treating apparatus to a user is disposed on the front of the cabinet 101.

A panel 120 supporting the upper circular guide 140 and the lower circular guide 150 is disposed in the cabinet 101. The panel 120 is disposed ahead of or behind the drum 110. The outer edge of the panel 120 makes a non-circular closed curve, corresponding to the cross-section of the drum 110. The panel 120 may be fixed to the cabinet 101.

Upper support rollers 141 supporting the upper circular guide 140 to be rotatable and lower support rollers 151 supporting the lower circular guide 150 to be rotatable are disposed on the panel 120. The panel 120 include a front panel 120*a* disposed behind the front of the cabinet 101 and a rear panel 120*b* disposed ahead of the rear of the cabinet 101.

The front panel 120*a* supporting a front upper circular guide 140*a* and a front lower circular guide 150*a* is disposed behind the front of the cabinet 101. The front panel 120*a* has the front upper circular guide 140*a* and the front lower circular guide 150*a* for keeping the shape of the drum 110.

The front panel 120*a* is disposed ahead of the open drum 110 and closes the open front of the drum 110. The closing means covering the open portion of the drum 110.

The front panel 120*a* supports the front upper circular guide 140*a* and the front lower circular guide 150*a* such that the front upper circular guide 140*a* and the front lower circular guide 150*a* can rotate. The front panel 120*a* is coupled to the cabinet 101 and supports the front upper circular guide 140*a* and the front lower circular guide 150*a* which carry the load of the drum 110.

Front upper support rollers 141*a* supporting the front upper circular guide 140*a* to be rotatable and front lower support rollers 151*a* supporting the front lower circular guide 150*a* to be rotatable are disposed on the front panel 120*a*.

The front panel 120*a* has a panel hole 121 for putting/taking laundry into/out of the drum, corresponding to the cabinet hole of the cabinet 101. The panel hole 121 is formed between the upper portion of the front lower circular guide 150*a* and the lower portion of the front upper circular guide 140*a*. The panel hole 121 is opened/closed by the door 106.

Discharge holes 128 and 129 through which the air in the drum 110 is discharged are formed through the front panel 120*a*. A plurality of discharge holes 128 and 129 may be formed. A suction duct 131 that sucks the air discharged from the drum 110 is coupled to the front panel 120*a*. The suction duct 131 is coupled to the front panel 120*a*, corresponding to the discharge holes 128 and 129.

A rear panel 120*b* supporting the rear upper circular guide 140*b* and the rear lower circular guide 150*b* is disposed ahead of the rear of the cabinet 101. The rear panel 120*b* has the rear upper circular guide 140*b* and the rear lower guide 150*a* for keeping the shape of the drum 110.

The front panel 120*a* is disposed behind the open drum 110 and closes the open rear of the drum 110. The closing means covering the open portion of the drum 110.

The rear panel 120*b* supports the rear upper circular guide 140*b* and the rear lower circular guide 150*b* such that the rear upper circular guide 140*b* and the rear lower circular guide 150*b* can rotate. The rear panel 120*b* is coupled to the cabinet 101 and supports the rear upper circular guide 140*b* and the rear lower circular guide 150*b* which carry the load of the drum 110.

Rear upper support rollers (not shown) supporting the rear upper circular guide 140*b* to be rotatable and rear lower support rollers (not shown) supporting the rear lower circular guide 150*b* are disposed on the rear panel 120*b*, similar to the front panel 120*a*. The rear upper support rollers (not shown) have the same shapes and structures as those of the front upper support rollers 141*a* and the rear lower support rollers (not shown) have the same shapes and structures as those of the front lower support rollers 151*a*, such that they are not shown in the figures and not described.

A suction hole 127 through which air heated by a heater (not shown) is sucked into the drum 110 is formed through the rear panel 120*b*. The suction hole 127 is formed between the upper portion of the rear lower circular guide 150*b* and the lower portion of the rear upper circular guide 140*b*. An intake duct 139 that is a passage through which the heated air flows into the drum 110 is coupled to the rear panel 120*b*. The suction duct 139 is coupled to the rear panel 120*b*, corresponding to the suction hole 127.

The rear panel 120*b* has a rotary disc panel that can rotate. The rotary panel 119 is rotatably coupled to the center of the rear panel 120*b*. The rotary panel 119 prevents damage to laundry due to friction with the rear panel 120*b* by being rotated by the laundry agitated with rotation of the drum 110.

The rotary panel 119 is disposed inside the drum 110 to cover the suction hole 127 of the rear panel 120*b*. The rotary panel 119 is rotatably coupled to the rear panel 120*b*, closer to the drum 110, that is, opposite the intake duct 139. Rotary panel holes 119*a* through which the heated air sucked into the suction hole 127 flows into the drum 110 are formed through the rotary panel 119. It is preferable to make the rotary panel holes 119*a* in very small size such that laundry cannot stick.

The drum 110 rotates with laundry therein. The drum 110 is a cylinder with the front and/or rear open such that laundry is received and air passes from the rear to the front. The front direction of the drum 110 is the direction to the front of the cabinet 101 where the front panel 120*a* is disposed and the rear direction of the drum 110 means the direction to the rear of the cabinet 101 where the rear panel 120*b* is disposed.

Only one of the front and rear of the drum 110 may be open or both of the front and rear of the drum 110 may be open. A lifter (not shown) may be disposed on the inner side of the drum to lift and drop laundry therein with the rotation of the drum 10.

The drum 110 has a non-circular closed cross-sectional with a distance not constant from the rotational center. A portion of the cross-section of the drum has a uniform distance from the rotational center of the upper circular guide 140 or the lower circular guide 150, such that the curvature is uniform. It is preferable the drum 110 takes the shape of the cabinet to secure a maximum receiving space in the cabinet.

The drum 110 has a non-circular closed cross-sectional with a distance not constant from the rotational center. The cabinet 101 has a rectangular shape with the vertical length larger than the horizontal length in the exemplary embodiment, such that it is preferable that the drum 110 has a distance between the top and the bottom larger than the distance between both sides. A portion of the cross-section of the drum 110 may have a uniform curvature, that is, a uniform radius. Further, a portion of the cross-section of the drum may be formed straight.

It is preferable that the drum 110 is made of elastic and flexible metal or high molecular compound to rotate with the non-circular closed cross-section maintained. The inner side of the drum 110 is supported by the upper circular guide 140 and the lower circular guide 150 so that the non-circular closed cross-section is maintained in rotation.

The portion having a uniform curvature at the upper portion of the drum is supported by the upper circular guide 140 and the portion having a uniform curvature at the lower portion of the drum 110 is supported by the lower circular guide 150.

It is preferable that the shapes of the upper circular guide 140 and the lower circular guide 150 are the same. It is preferable that the diameters of the upper circular guide 140 and the lower circular guide 150 are the same.

The upper circular guide 140 and the lower circular guide 150 are alternately disposed to be supported by the panel 120. The lower portion of the upper circular guide 140 and the upper portion of the lower circular guide 150 overlap each other. It is preferable that most portions of the upper circular guide 140 and the lower circular guide 150 overlap each other. It is preferable that the rotational center of the upper circular guide 140 and the rotational center of the lower circular guide 150 are disposed between the lower portion of the upper circular guide 140 and the upper portion of the lower circular guide 150.

The front panel 120*a* is disposed ahead of the drum 110 and the rear panel 120*b* is disposed behind the drum 110. The open front of the drum 110 is closed by the front panel 120*a* and the open rear of the drum 110 is closed by the rear panel 120*b*. The closing means being positioned at the open portion of the drum 110 covering the open portion. It is preferable that the portion between the front of the drum 110 and the front panel 120*a* is sealed and the portion between the rear of the drum 110 and the rear panel 120*b* is sealed.

The upper circular guide 140 supports the portion having a uniform curvature at the upper portion of the drum 110. The upper circular guide 140 is formed in a circular ring shape and rotatably disposed on the panel 120. The upper circular guide 140 supports the drum by applying a vertical drag force outward to the drum 110, in contact with the inner side of the upper portion of the drum 110. The upper circular guide 140 rotates with the drum 110, carrying the load of the drum 110.

The portion of the drum 110 which is supported by the upper circular guide 140 is at a constant distance from the rotation center of the upper circular guide 140. It is preferable the upper circular guide 140 supports the upper inner side of the drum 110, with the rotational center higher than the rotational center or the drum.

It is preferable that the upper circular guide 140 is in contact with the inner side of the upper portion of the drum 110 in as large area as possible to be able to carry the load of the drum 110. The upper circular guide 140 is formed large enough such that the rotational center of the drum 110 is positioned inside it.

The upper circular guide 140 rotates with the drum 110 in contact with the portion having a uniform curvature at the upper portion of the drum 110 such that the drum 110 rotates with the non-circular closed cross-section maintained. It is preferable that the upper circular guide 140 is rotatably supported by the panel 120.

The upper circular guide 140 is composed of a plurality of parts of the front upper circular guide 140*a* supporting the upper inner side of the front edge of the drum 110 and the rear upper circular guide 140*b* supporting the upper inner side of the rear edge of the drum 110. The front upper circular guide 140*a* is supported by the front panel 120*a* and the rear upper circular guide 140*b* is supported by the rear panel 120*b*.

The front upper circular guide 140*a* is disposed on the front panel 120*a* with the panel hole 121 inside the front upper circular guide 140*a*. That is, the panel hole 121 is disposed inside the ring-shaped front upper circular guide 140*a*.

The lower circular guide 150 supports the portion having a uniform curvature at the lower portion of the drum 110. The lower circular guide 150 is formed in a circular ring shape and rotatably disposed on the panel 120. The lower circular guide 150 supports the drum by applying a vertical drag force outward to the drum 110, in contact with the inner side of the lower portion of the drum 110. The upper circular guide 150 rotates with the drum 110, keeping the shape of the drum 110.

The portion of the drum 110 which is supported by the lower circular guide 150 is at a constant distance from the rotation center of the lower circular guide 150. It is preferable the lower circular guide 150 supports the lower inner side of the drum 110, with the rotational center lower than the rotational center or the drum.

It is preferable that the lower circular guide 150 is in contact with the inner side of the lower portion of the drum 110 in as large area as possible to be able to carry the load of the drum 110. The lower circular guide 150 is formed large enough such that the rotational center of the drum 110 is positioned inside it.

The lower circular guide 150 rotates with the drum 110 in contact with the portion having a uniform curvature at the lower portion of the drum 110 such that the drum 110 rotates with the non-circular closed cross-section maintained. It is preferable that the lower circular guide 150 is rotatably supported by the panel 120.

The lower circular guide 150 is composed of a plurality of parts of the front lower circular guide 150*a* supporting the lower inner side of the front edge of the drum 110 and the rear lower circular guide 150*b* supporting the lower inner side of the rear edge of the drum 110. The front lower circular guide 150*a* is supported by the front panel 120*a* and the rear lower circular guide 150*b* is supported by the rear panel 120*b*.

The front lower circular guide 150*a* is disposed on the front panel 120*a* with the panel hole 121 inside the front lower circular guide 150*a*. That is, the panel hole 121 is disposed inside the ring-shaped front lower circular guide 150*a*.

The upper front circular guide 140*a* and the lower front circular guide 150*a* are disposed close to the front of the cabinet 101, opposite the drum 110, with respect to the front panel 120*a*. That is, the upper front circular guide 140*a* and the lower front circular guide 150*a* are disposed between the front of the cabinet 101 and the front panel 120*a*.

The upper front circular guide 140*a* and the lower front circular guide 150*a* are alternately disposed to be supported by the panel 120. The lower portion of the upper front circular guide 140*a* and the upper portion of the lower front circular guide 150*a* overlap each other and the lower front circular guide 150*a* is disposed ahead of the upper front circular guide 140*a* in the exemplary embodiment.

The upper rear circular guide 140*b* and the lower rear circular guide 150*b* are disposed close to the rear of the cabinet 101, opposite the drum 110, with respect to the rear panel 120*b*. That is, the upper rear circular guide 140*b* and the lower rear circular guide 150*b* are disposed between rear of the cabinet 101 and the rear panel 120*b*.

The upper rear circular guide 140*b* and the lower rear circular guide 150*b* are alternately disposed to be supported by the rear panel 120*b*. The lower portion of the upper rear circular guide 140*b* and the upper portion of the lower rear circular guide 150*b* overlap each other and the lower rear circular guide 150*b* is disposed behind the upper rear circular guide 140*b* in the exemplary embodiment.

The upper support rollers 141 are disposed between the upper circular guide 140 and the panel 120 and support the upper circular guide 140. The upper support rollers 141 are rotatably coupled to the panel 120. The upper support rollers 141 support the inner side of the ring-shaped upper circular guide 140. The upper support rollers 141 rotates relatively to the upper circular guide 140 such that the upper circular guide 140, which rotates with the drum 110, can rotate.

When the upper circular guide 140 coupled to the inner side of the drum 110 rotates with the drum 110 or rotates with a little difference from the drum 110, the upper support rollers 141 rotates the upper circular guide 140 relatively on the panel 120. Since the upper support rollers 141 are disposed between the upper circular guide 140 and the panel 120 while supporting the upper circular guide 140 such that the upper circular guide 140 can make relative rotation, the upper circular guide 140 can rotate with the drum 110 in rotation of the drum 110.

The upper circular guide 140 rotates with the outer sides of the upper support rollers 141 in contact with the inner side of the upper circular guide 140. Rotary shafts of the upper support rollers 141 are fixed to the panel 120, the upper support rollers 141 rotate on the panel 120, and the inner side of the upper circular guide 140 relatively rotates in contact with the outer sides of the upper support rollers 141 in rotation of the upper circular guide 140.

It is preferable that a plurality of upper support rollers 141 is provided. The upper support rollers 141 are disposed, at least one piece at the upper portion and at least one piece at the lower portion, with respect to the rotational center of the upper circular guide 140. The upper support rollers 141 include upper-upper support rollers 141-1 disposed above the rotational center of the upper circular guide 140 and lower-upper support rollers 141-2 disposed below the rotational center of the upper circular guide 140.

The upper-upper support rollers 141-1 are in contact with the inner side above the rotational center of the upper circular guide 140. The upper-upper support rollers 141-1 are disposed between the upper portion of the upper circular guide 140 and the upper portion of the lower circular guide 150.

A plurality of upper-upper support rollers 141-1 may be provided, but two are provided in the exemplary embodiment. Two upper-upper support rollers 141-1 are symmetrically arranged with respect to a vertical line on the rotational center of the upper circular guide 140.

The lower-upper support rollers 141-2 are in contact with the inner side below the rotational center of the upper circular guide 140. The lower-upper support rollers 141-2 are disposed between the upper portion of the lower circular guide 150 and the lower portion of the upper circular guide 140. It is preferable that the lower-upper support rollers 141-2 are disposed below the rotational center of the lower circular guide 150.

A plurality of lower-upper support rollers 141-2 may be provided, but two are provided in the exemplary embodiment. Two lower-upper support rollers 141-2 are symmetrically arranged with respect to a vertical line on the rotational center of the upper circular guide 140.

It is preferable that the upper-upper support rollers 141-1 are larger in diameter than the lower-upper support rollers 141-2. This is because most of the load that the upper circular guide 140 carries is carried by the upper-upper support rollers 141-1.

The lower support rollers 151 are disposed between the lower circular guide 150 and the panel 120 and support the lower circular guide 150. The lower support rollers 151 are rotatably coupled to the panel 120. The lower support rollers 151 support the inner side of the ring-shaped lower circular guide 150. The lower support rollers 151 rotates relatively to the lower circular guide 150 such that the lower circular guide 150, which rotates with the drum 110, can rotate.

When the lower circular guide 150 coupled to the inner side of the drum 110 rotates with the drum 110 or rotates with a little difference from the drum 110, the lower support rollers 151 rotates the lower circular guide 150 relatively on the panel 120. Since the lower support rollers 151 are disposed between the lower circular guide 150 and the panel 120 while supporting the lower circular guide 150 such that the lower circular guide 150 can make relative rotation, the lower circular guide 150 can rotate with the drum 110 in rotation of the drum 110.

The lower circular guide 150 rotates with the outer sides of the lower support rollers 151 in contact with the inner side of the lower circular guide 150. Rotary shafts of the lower support rollers 151 are fixed to the panel 120, the lower support rollers 151 rotate on the panel 120, and the inner side of the lower circular guide 150 relatively rotates in contact with the outer sides of the lower support rollers 151 in rotation of the lower circular guide 150.

It is preferable that a plurality of lower support rollers 151 is provided. The lower support rollers 151 are disposed, at least one piece at the upper portion and at least one piece at the lower portion, with respect to the rotational center of the lower circular guide 150. The lower support rollers 151 include upper-lower support rollers 151-1 disposed above the rotational center of the lower circular guide 150 and lower-lower support rollers 151-2 disposed below the rotational center of the lower circular guide 150.

The upper-lower support rollers 151-1 are in contact with the inner side above the rotational center of the lower circular guide 150. The upper-lower support rollers 151-1 are disposed between the upper portion of the lower circular guide 150 and the lower portion of the upper circular guide 140. It is preferable that the upper-lower support rollers 151-1 are disposed above the rotational center of the upper circular guide 140.

A plurality of upper-lower support rollers 151-1 may be provided, but two are provided in the exemplary embodiment. Two upper-lower support rollers 151-1 are symmetrically arranged with respect to a vertical line on the rotational center of the lower circular guide 150.

The lower-lower support rollers 151-2 are in contact with the inner side below the rotational center of the lower circular guide 150. The lower-lower support rollers 151-2 are disposed between the lower portion of the upper circular guide 140 and the lower portion of the lower circular guide 150.

A plurality of lower-lower support rollers 151-2 may be provided, but two are provided in the exemplary embodiment. Two lower-lower support rollers 151-2 are symmetrically arranged with respect to a vertical line on the rotational center of the lower circular guide 150.

It is preferable that the upper-lower support rollers 151-1 are smaller in diameter than the lower-lower support rollers 151-2. This is because most of the load that the lower circular guide 150 carries is carried by the lower-lower support rollers 151-2.

The driving mechanism 170 rotates the drum 110. The driving mechanism 170 is implemented in various ways that can rotate the drum 110, but includes a driving belt 175 and a motor 172 in the exemplary embodiment.

The driving belt 175 and the motor 172 allow the drum 110 to rotate with the non-circular closed cross-section maintained. The driving belt 175 applied a vertical drag force inward to the drum 110 in contact with the outer side of the drum 110 without slipping, and rotates the drum 110 using the rotational force from the motor 172.

It is preferable that the driving belt 175 is made of elastic and flexible high molecular compounds or metal. It is preferable that the driving belt 175 is made of a material with a high fiction coefficient such that it does not slide on the outer side of the drum 110, or the inner side of the driving belt 175 and the outer side of the drum 110 are embossed such that there is no slip between them.

The motor 172 revolves the driving belt 175 by generating a rotational force. The rotational force generated by the motor 171 is transmitted by the driving belt 175 and rotates the drum 110.

The driving belt 175 allows the drum 110 to rotate with the shape maintained while carrying the load 110 in cooperation with the upper circular guide 140 and the lower circular guide 150, which apply drag forces outward to the drum 110, by applying a drag force inward to the drum 110. That is, the driving belt 175 rotates the drum 110 while supporting the drum 110.

The hot air supplier 130 heats and supplies air into the drum 110 while discharging the air in the drum 110. The hot air supplier 130 includes a heater (not shown) that heats air, the intake duct 139 that guides the air heated by the heater into the drum 110, the suction duct 131 that sucks the air discharged from the drum 110, and a discharge duct 133 through which the air sucked into the suction duct 131 flows.

The suction duct 131 is coupled to the front panel 120*a*, corresponding to the discharge holes 128 and 129. The suction duct 131 is disposed ahead of the front panel 120*a*. A filter that removes foreign substances in the air may be disposed in the suction duct 131. The suction duct 131 is connected with the discharge duct 133. A fan (not shown) that blows air may be disposed in the discharge duct 133. The air flowing into the discharge duct 133 may be discharged outside the cabinet 101 or may circulate through the intake duct 139 connected to the discharge duct 133.

A fan (not shown) that blows air may be disposed in the intake duct 139. A heater may be disposed in the intake duct 139. The suction duct 139 is coupled to the rear panel 120*b*, corresponding to the suction hole 127.

A fixing-typed condensate water tank 168 and a drawer-typed condensate water tank 169 receive condensate water produced from the drum 110.

The fixing-typed condensate water tank 168 is formed in a hexagonal shape with a small height. The top and bottom of the fixing-typed condensate water tank is formed to correspond to the top of the cabinet 101. The fixing-typed condensate water 168 has a small height such that the cabinet 101 is not increased in height and the capacity of receiving condensate water is the maximum, and is disposed between the top of the cabinet 101 and the drum 110.

The drawer-typed condensate water tank 169 is connected with the fixing-typed condensate water tank 168 and the condensate water received in the fixing-typed condensate water tank flows and is received in the drawer-typed condensate water tank 169. The drawer-typed condensate water tank 169 slides forward/backward to be drawn out of the cabinet 101. A user can draw the drawer-typed condensate water tank 169 out of the cabinet 101 and then remove condensate water in the tank.

The drawer-typed condensate tank 169 is received in a space defined by the fixing-typed condensate water tank 168, one side of the cabinet 101, and the drum 110. The drawer-typed condensate tank 169 is formed to correspond to the space defined by the fixing-typed condensate water tank 168, the side of the cabinet 101, and the drum 110 such that the space that the drawer-typed condensate tank 169 occupies is the minimum with maximum capacity of receiving condensate water. The drawer-typed condensate water tank 169 is formed similar to a triangular prism that is long in the front-rear direction. The top of the drawer-typed condensate tank 169 is horizontal, the side is vertical, and the other side is curved to correspond to the drum 110.

Figure 6:
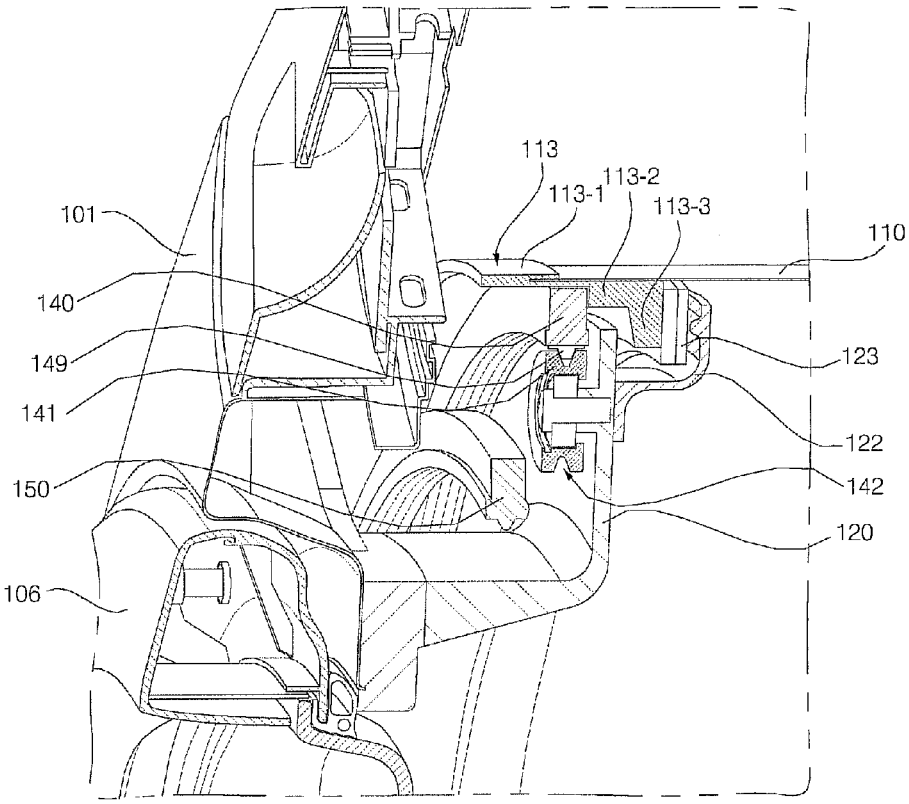
FIG. 6 is a partial cross-sectional view showing a sealing structure of a drum and the circular guide of the laundry treating apparatus according to an exemplary embodiment of the present invention.

FIG. 6 is a partial cross-sectional view showing a sealing structure of a drum and the circular guide of the laundry treating apparatus according to an exemplary embodiment of the present invention.

A U-shaped or V-shaped roller groove 142 is formed on the outer sides of the upper support rollers 141. Further, a roller insertion 149 inserted in the roller grooves 142 is formed around the inner side of the upper circular guide 140. The roller insertion 149 has one side fixed to the inner side of the upper circular guide 140 and the other side protruding to correspond to the shape of the roller grooves 142. It is preferable that the roller insertion 149 is made of an elastic member to increase a friction force with the upper support rollers 141 and reduce vibration or noise due to rotation of the upper circular guide 140.

The roller grooves 142 may be applied to the lower support rollers 151 and the roller insertion 149 may be formed around the inner side of the lower circular guide 150.

A drum guide 113 that prevents the drum 110 from separating from the upper circular guide 140 by sealing the portion between the drum 110 and the upper circular guide 140 may be disposed around the edge of the drum 110 in the exemplary embodiment. Further, a panel sealer 123 that seals the portion between the drum 110 and the panel 120 is disposed on the panel 120. The panel sealer 123 is supported by a panel bracket 122 coupled to the panel 120.

The drum guide 113 covers the edge of the drum 110. The drum guide 113 is in contact with the outer side of the upper circular guide 140. It is preferable that the drum guide 113 is made of a material with a small friction coefficient such that the drum 110 can smoothly rotate even if it comes in contact with the upper circular guide 140 and/or the panel sealer 123.

It is preferable that the drum guide 113 is made of a synthetic material with PTFE oil or may be made of fabric or rubber, depending on exemplary embodiments. It is preferable that a plurality of drum guides 113 is disposed around the front edge of the drum 110 and the rear edge of the drum 110.

The drum guide 113 has a drum guide edge 113-1 covering the edge of the drum 110, a first drum guide protrusion 113-2 bending to come in contact with a portion of the side of the upper circular guide 140 and protruding inside the drum 110, and a second drum guide protrusion 113-3 protruding inside the drum 110 from the first drum guide protrusion 113-2, with the side in contact with the panel sealer 123.

The drum guide edge 113-1 covers the edge of the drum 110. The drum guide edge 113-1 covers a portion of the outer side and the inner side and a side of the edge of the drum 110. The portion covering the inner side of the drum 110, of the drum guide edge 113-1, is in contact with the outer side of the upper circular guide 140. The portion covering the inner side of the drum 110, of the drum guide edge 113-1, extends to the first drum guide protrusion 113-2.

The first drum guide protrusion 113-2 protrudes inside the drum 110 from the inner side of the drum 110, that is, toward the rotational center of the drum 100. The first drum guide protrusion 113-2 bends from the portion covering the inner side of the drum 110, f the drum guide edge 113-1, and protrudes inside the drum 110.

A side of the first drum guide protrusion 113-2 is in contact with a portion of a side of the upper circular guide 140. The first drum guide protrusion 113-2 prevents the drum 110 from separating from the upper circular guide 140 in rotation of the drum 110. The drum 110 vibrates at an angle in the front-rear direction in rotation due to unbalance of the drum 110. With the drum 110 vibrating, a side of the first drum guide protrusion 113-2 prevents the drum 110 from separating from the upper circular guide 140 by guiding a side of the upper circular guide 140.

The second drum guide protrusion 113-3 extends from the first drum guide protrusion 113-2, bends from the first drum guide protrusion 113-2, and protrudes inside the drum 110, that is, toward the rotational center of the drum 110. The second drum guide protrusion 113-3 protrudes inside the drum 110 further than the first drum guide protrusion 113-2.

The second drum guide protrusion 113-3 is disposed between the panel 120 and the panel sealer 123. A side of the second drum guide protrusion 113-3 is in contact with a side of the panel sealer 123. The second drum guide protrusion 113-3 seals the portion between the drum 110 and the panel 120 in cooperation with the panel sealer 123.

The panel bracket 122 is coupled to the panel 120 and supports the panel sealer 123. The panel bracket 122 is formed in a rim shape with the inner side (in the direction of the rotational center) protruding to the panel 120 such that a space is defined between the panel and the panel bracket 122. The outer edge of the panel bracket 122 is formed in a non-circular closed curve corresponding to the outer edge of the panel 120. The panel sealer 123 and the second drum guide protrusion 113-3 of the drum guide 113 is disposed in the space between the panel bracket 122 and the panel 120.

The panel sealer 123 is disposed on the outer side (opposite to the rotational center) of the panel bracket 122. The panel sealer 123 seals the portion between the panel 120 and the drum 110 in cooperation with the drum 110 and the drum guide 113. The panel sealer 123 is in contact with the panel-sided side of the panel bracket 122. A side of the panel sealer 123 is in contact with a side of the second drum guide protrusion 113-3. The top of the panel sealer 123 is in contact with the inner side of the drum 110. The panel sealer 123 is disposed between the panel bracket 122 and the second drum guide 113-3 of the drum guide 113.

The panel sealer 123 is formed in the shape of a rim. The outer edge of the panel sealer 123 is formed in a non-circular closed curve corresponding to the outer edge of the panel bracket 122.

It is preferable that the panel sealer 123 is made of a synthetic material with PTFE (polytetrafluoroethylene) oil with a small friction coefficient, for sealing and reducing friction. The panel sealer 123 may be made of fabric or rubber, depending on exemplary embodiments. The panel sealer 123 may be formed by overlapping a plurality of members made of different materials.

Since the lower circular guide 150 overlaps and alternates with the upper circular guide 140, the drum guide edge 113-1 is in contact with the outer side of the lower circular guide 140, but the drum guide protrusion 113-2 is not in contact with a side of the lower circular guide 150.

In accordance with the arrangement of the upper circular guide 140 and the lower circular guide 150, the description of the drum guide 113 and the panel sealer 123 may be applied to the lower circular guide 150. That is, the drum guide edge 113-1 is in contact with the outer sides of the upper circular guide 140 and the lower circular guide 150 and the first drum guide protrusion 113-2 is in contact with a portion of a side of the lower circular guide 150, but may not be in contact with a side of the upper circular guide 140.

Figure 7:
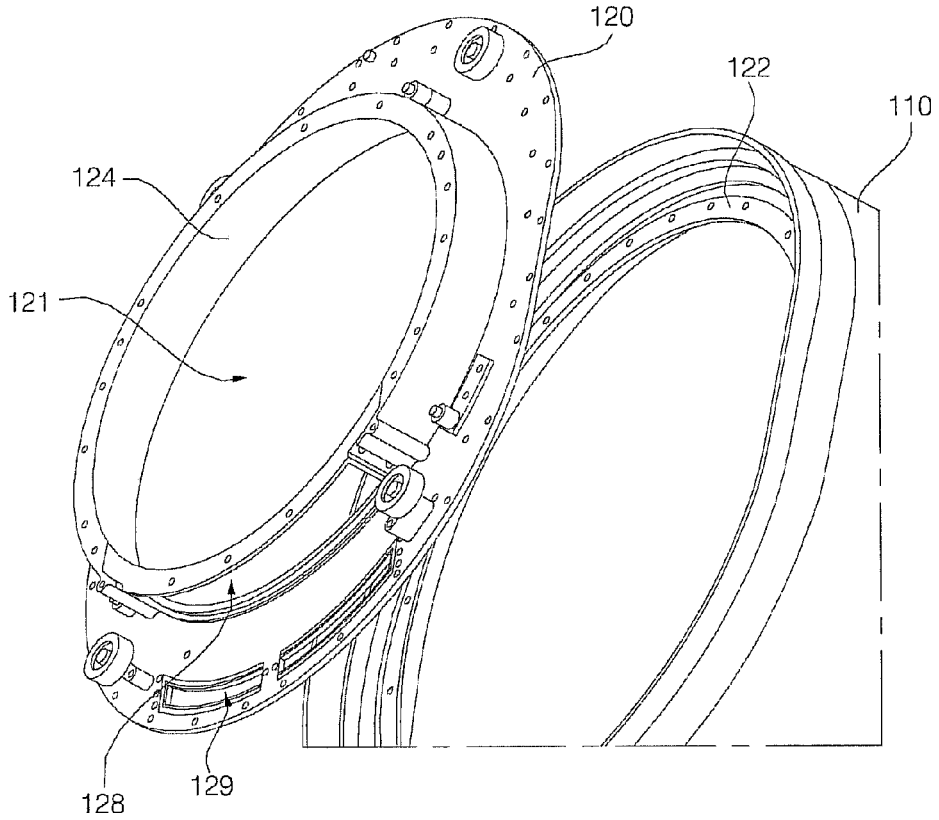
FIG. 7 is a partial perspective view showing a front panel of the laundry treating apparatus according to an exemplary embodiment of the present invention.
Figure 8:
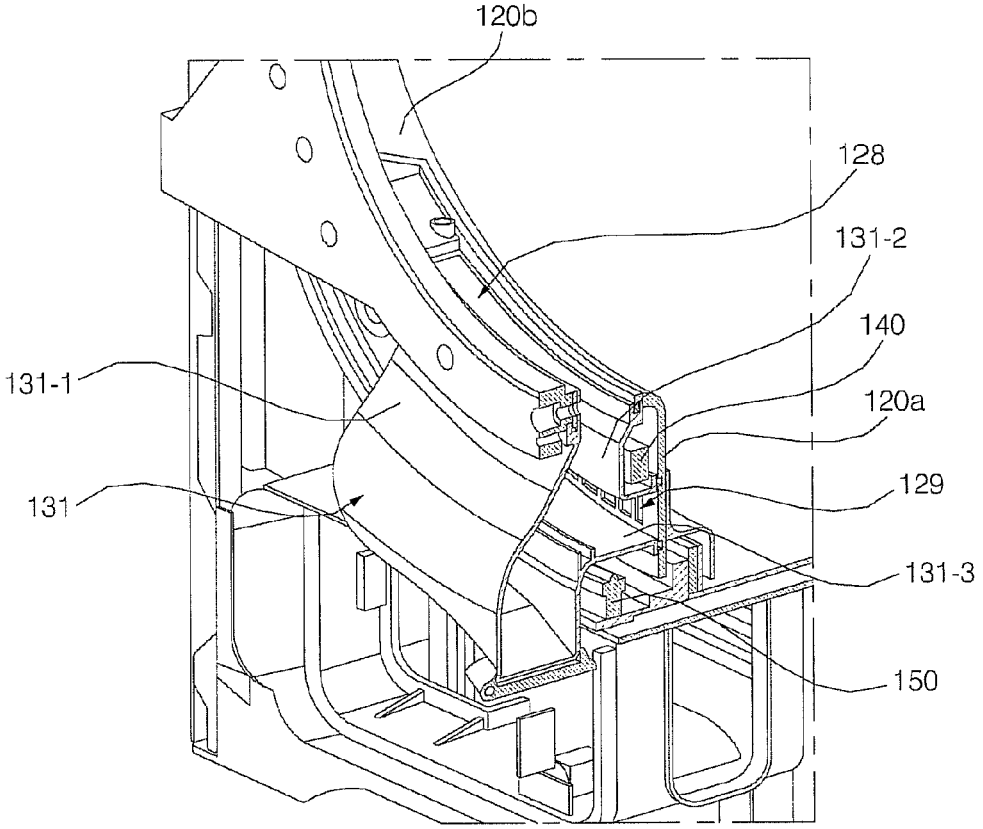
FIG. 8 is a partial front cross-sectional view showing the structure of a suction duct of the laundry treating apparatus according to an exemplary embodiment of the present invention.
Figure 9:
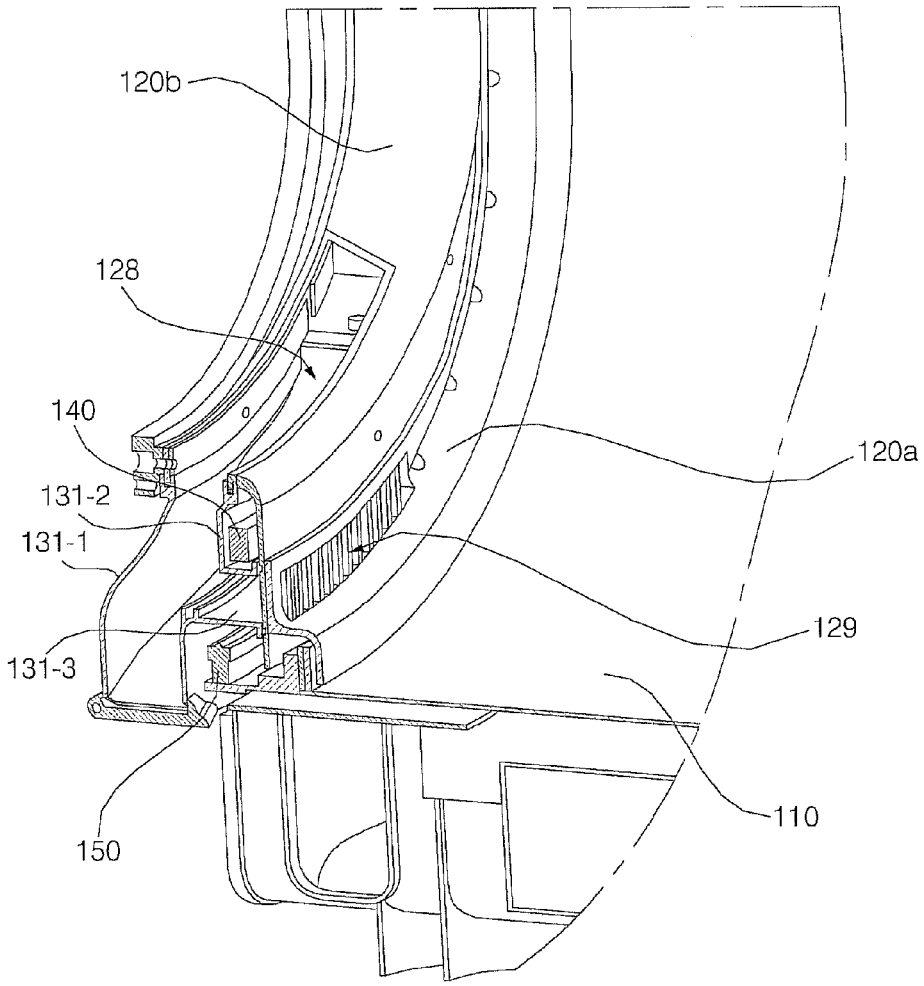
FIG. 9 is a partial rear cross-sectional view showing the structure of the suction duct of the laundry treating apparatus according to an exemplary embodiment of the present invention.

FIG. 7 is a partial perspective view showing a front panel of the laundry treating apparatus according to an exemplary embodiment of the present invention. FIG. 8 is a partial front cross-sectional view showing the structure of a suction duct of the laundry treating apparatus according to an exemplary embodiment of the present invention. FIG. 9 is a partial rear cross-sectional view showing the structure of the suction duct of the laundry treating apparatus according to an exemplary embodiment of the present invention.

The front panel **120*a* has a panel protrusion 124 protruding forward around the panel hole 121. The panel protrusion 124 is formed such that the circumference of the panel hole 121 of the front panel 120*a* protrudes to the cabinet 101. As the panel protrusion 124 protrudes to the cabinet 101, the panel hole 121 formed at the center is opened/closed by the door 106. The panel protrusion 124 defines the space where the front upper circular guide 140*a* and the front lower circular guide 150*a* are disposed, by protruding to the cabinet 101**.

A first discharge hole 128 is formed through the side of the lower portion of the panel protrusion 124. As the first discharge hole 128 is formed through the side of the lower portion of the panel protrusion 124, the air in the drum 110 is discharged downward.

A second discharge hole 129 is formed at the lower portion of the front panel **120*a*. The second discharge hole is formed below the panel protrusion 124 of the front panel 120*a*. The second discharge hole 129 is formed at the portion, which corresponds to the lower portion of the front upper circular guide 140*a* and the lower portion of the front lower circular guide 150*a*, in the front panel 120*a*. The second discharge hole 129 is formed through the front panel 120*a* such that the air in the drum 110 is discharged between the lower portion of the front upper circular guide 140*a* and the lower portion of the front lower circular guide 150*a***.

The suction duct 131 sucks the air in the drum 110 which is discharged through the first discharge hole 128 and the second discharge hole 129. The air sucked into the suction duct 131 flows into the discharge duct 133.

The suction duct 131 is coupled to the front panel **120*a*, corresponding to the first discharge hole 128 and the second discharge hole 129. The suction duct 131 covers the lower portion of the front upper circular guide 140***a* and the lower portion of the front lower circular guide 150*a* at a predetermined distance and is coupled to the 120*a*, communicating with the first discharge hole 128 and the second discharge hole 129.

The suction duct 131 is divided into a plurality of members, and in the exemplary embodiment, the suction duct 131 includes a first suction duct member 131-1, a second suction duct member 131-2, and a third suction duct member 131-3.

The first suction duct 131-1 forms the front of the suction duct 131. The upper portion of the first suction duct 131-1 is connected with the protruding end of the panel protrusion 124. The upper portion of the first suction duct member 131-1 is coupled to the front panel 120*a* around the first discharge hole 128.

The second suction duct member 131-2 is coupled to the front panel 120*a*, covering the lower portion of the front upper circular guide 140*a* at a predetermined distance. The upper portion of the first suction duct 131-2 is connected with the protrusion start portion of the panel protrusion 124. The upper portion of the second suction duct member 131-2 is coupled to the front panel 120*a* around the first discharge hole 128. The lower portion of the second suction duct member 131-2 is coupled to the front panel 120*a* above the circumference of the second discharge hole.

The third suction duct member 131-3 is coupled to the front panel 120*a*, covering the lower portion of the front lower circular guide 150*a* at a predetermined distance. The upper portion of the third suction duct member 131-3 is coupled to the front panel 120*a* below the circumference of the second discharge hole.

The upper portion of the first suction duct 131-1 and the upper portion of the second suction duct member 131-2 forms a hole communicating with the first discharge hole 128, while the lower portion of the second suction duct member 131-2 and the upper portion of the third suction duct member 131-3 forms a hole communicating with the second discharge hole 129. The lower portion of the first suction duct member 131-1 and the lower portion of the third suction duct member 131-3 are connected with the discharge duct 133.

Figure 10:
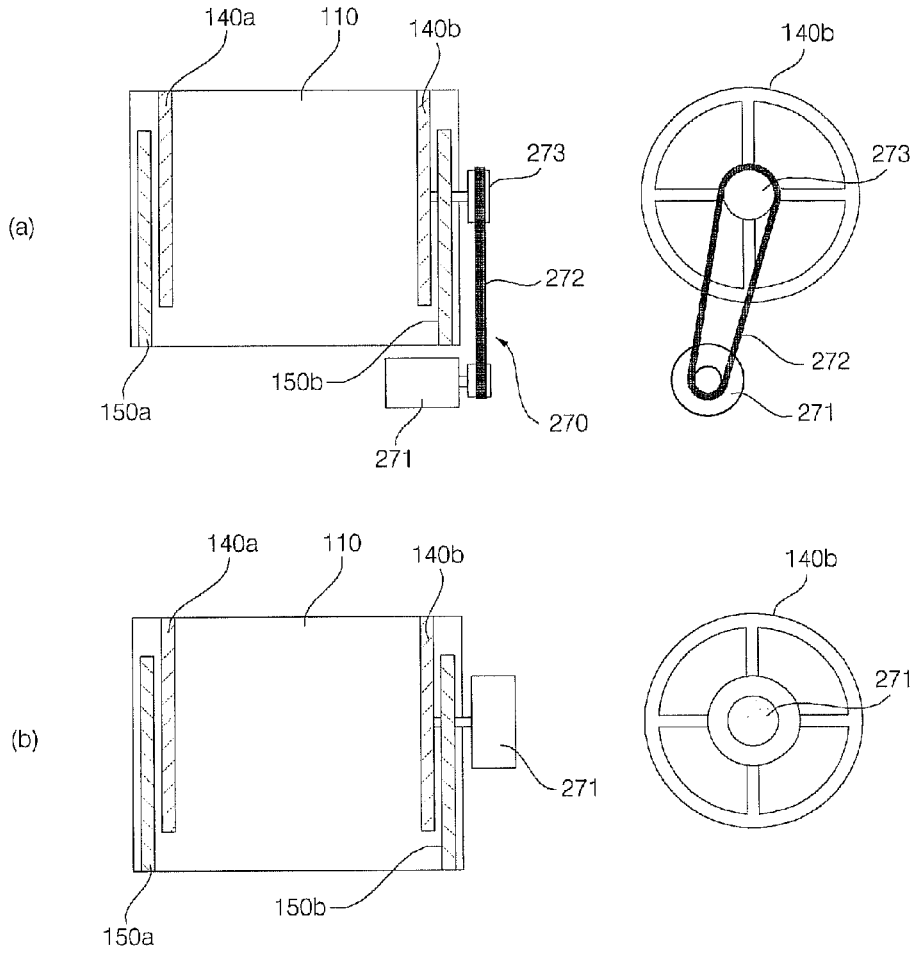
FIG. 10 is a view showing the structure of a driving unit of a laundry treating apparatus according to another exemplary embodiment of the present invention.

FIG. 10 is a view showing the structure of a driving unit of a laundry treating apparatus according to another exemplary embodiment of the present invention.

A driving mechanism 270 according to another exemplary embodiment of the present invention rotates the drum 110 by rotating the upper circular guide 140 or the lower circular guide 150. In the exemplary embodiment, the driving mechanism 270 rotates the upper circular guide 140, and particularly, it is preferable that the driving mechanism 270 rotates the rear upper circular guide 140*b*.

The driving mechanism 270 may be implemented in various ways for rotating the upper circular guide 140.

Referring to (a) of FIG. 10, the driving mechanism 270 may include a driving wheel 273 connected to the upper circular guide 140 with the same rotary shaft, a motor 271 generating a rotational force, and a driving belt 272 transmitting the rotational force from the motor 271 to the driving wheel 273.

Referring to (b) of FIG. 10, the driving mechanism 270 may be the motor 271 directly connected to the rotational center of the upper circular guide 140.

In the exemplary embodiment, it is preferable that the drum guide 113 is made of a material with a high friction coefficient at the portion being in contact with the upper circular guide 140 such that it does not slip on the upper circular guide 140. That is, it is preferable that the drum guide 113 has a high friction force against the upper circular guide 140.

The portion of the drum guide 113 which is in contact with the upper circular guide 140 may be embossed and the outer side of the upper circular guide 140 may be embossed such that the drum guide 113 does not slip on the upper circular guide 140.

Figure 11:
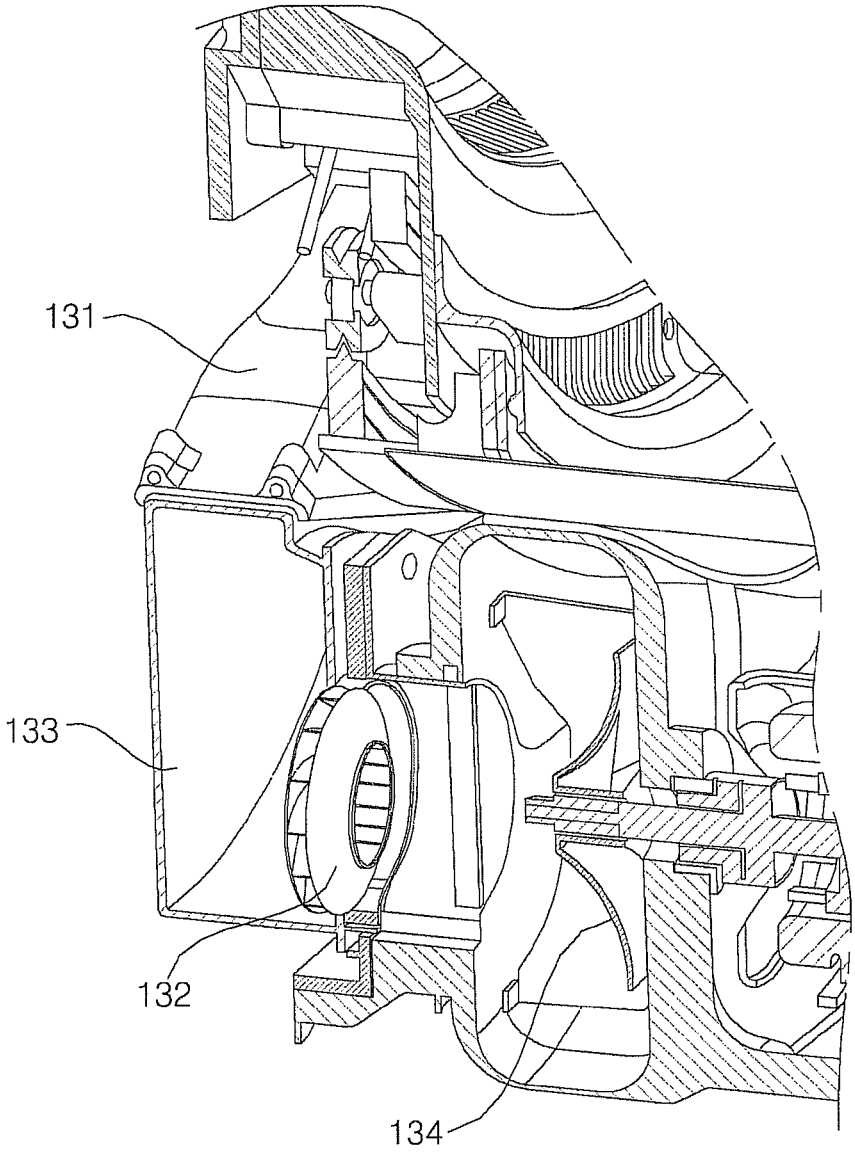
FIG. 11 is a view partially showing the internal structure of a hot air supplier of the laundry treating apparatus according to an exemplary embodiment of the present invention.
Figure 12:
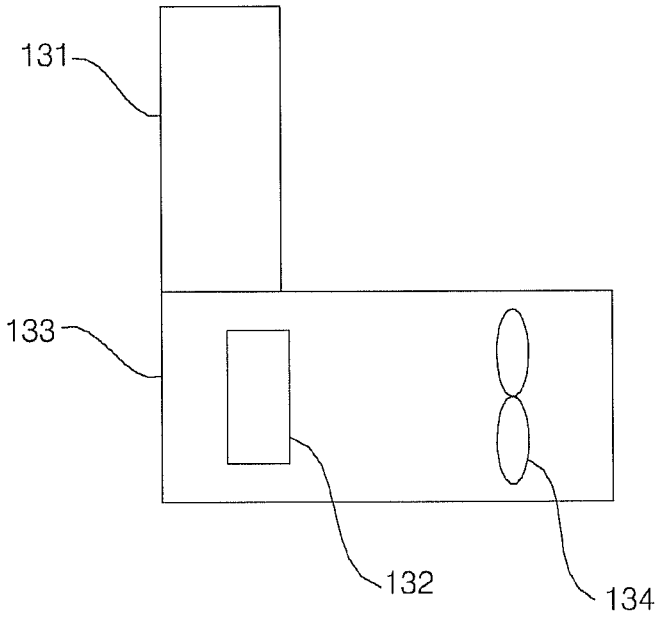
FIG. 12 is a partial schematic view of the hot air supplier shown in FIG. 11.

FIG. 11 is a view partially showing the internal structure of a hot air supplier of the laundry treating apparatus according to an exemplary embodiment of the present invention. FIG. 12 is a partial schematic view of the hot air supplier shown in FIG. 11.

A turbo fan 132 that sucks the air in the drum 110 is disposed in the discharge duct 133. The discharge duct 133 is disposed under the suction duct 131. The turbo fan 132 is disposed in the discharge duct 133 under the suction duct 131. It is preferable that the turbo fan 132 is arranged with the side corresponding to the lower portion of the suction duct 131.

A fan 134 blowing the air in the discharge duct 133 is disposed behind the turbo fan 132. The fan 134 is disposed in the discharge duct 133 and discharges the air in the discharge duct 133 to the outside of the cabinet 101 or guides the air to the discharge duct 133.

Figure 13:
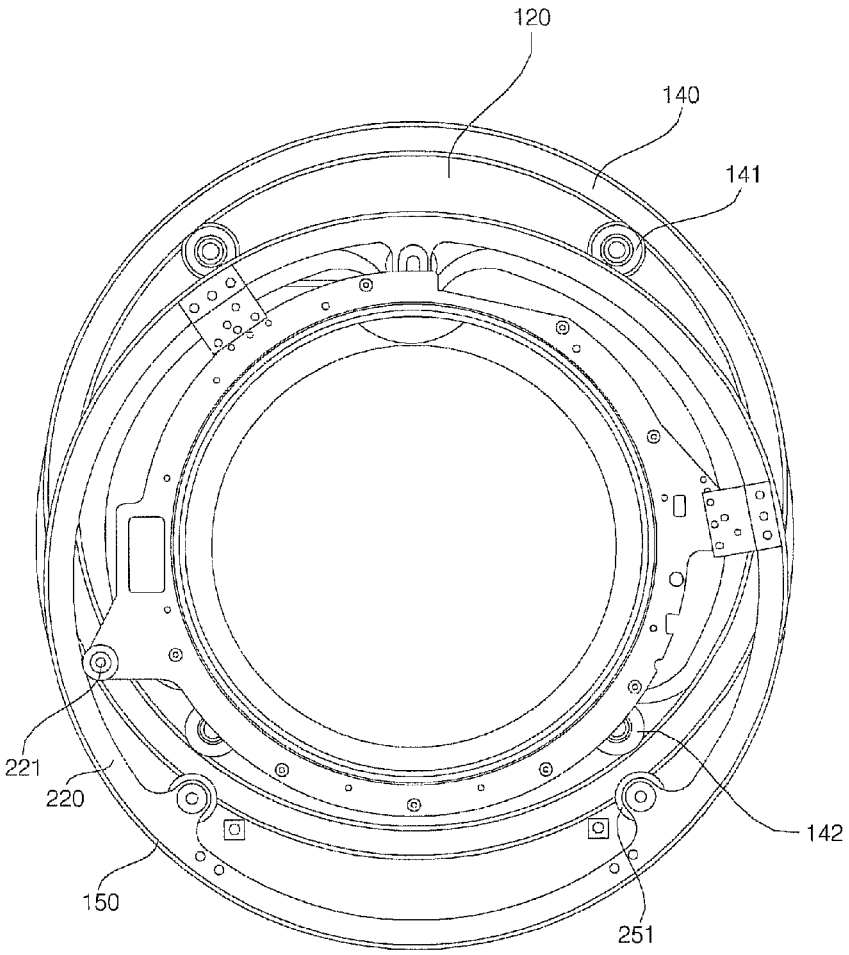
FIG. 13 is a front view showing inter-shaft distance controller of a laundry treating apparatus according to another exemplary embodiment of the present invention.

FIG. 13 is a front view showing inter-shaft distance adjuster of a laundry treating apparatus according to another exemplary embodiment of the present invention.

A laundry treating apparatus according to another exemplary embodiment of the present invention further includes an inter-shaft distance adjuster 220 supporting the lower circular guide 150 to be rotatable. The inter-shaft distance adjuster 220 is coupled to the panel 120 such that the distance from the rotational center of the upper circular guide 140 to the rotational center of the lower circular guide 150 changes.

It is preferable that the inter-shaft distance adjuster 220 is formed in a circular ring shape, corresponding to the lower circular guide 150. Lower support rollers 251 supporting the lower portion of the lower circular guide 150 are mounted on the inter-shaft distance adjuster 220. The lower support rollers 251 are rotatably coupled to the inter-shaft distance adjuster 220. The lower support rollers 251 support the inner side of the ring-shaped lower circular guide 150.

It is preferable the inter-shaft distance adjuster 220 is rotatably coupled to the panel 120. The inter-shaft distance adjuster 220 and the panel 120 is coupled by a rotary fin 221 to relatively rotate. The inter-shaft distance adjuster 220 rotates about the rotary pin 221, such that the distance from the rotational center of the upper circular guide 140 and the rotational center of the lower circular guide 150 changes.

It is preferable that the rotary pin 221 is disposed outside the lower circular guide 150. It is preferable that the rotary pin 221 is disposed below the rotational center of the lower circular guide 150.

When the drum 110 is combined with the upper circular guide 140 and the lower circular guide 150, the drum 110 can be easily combined by reducing the distance from the rotational center of the upper circular guide 140 to the rotational center of the lower circular guide 150 by rotating the inter-shaft distance adjuster 220.

Figure 14:
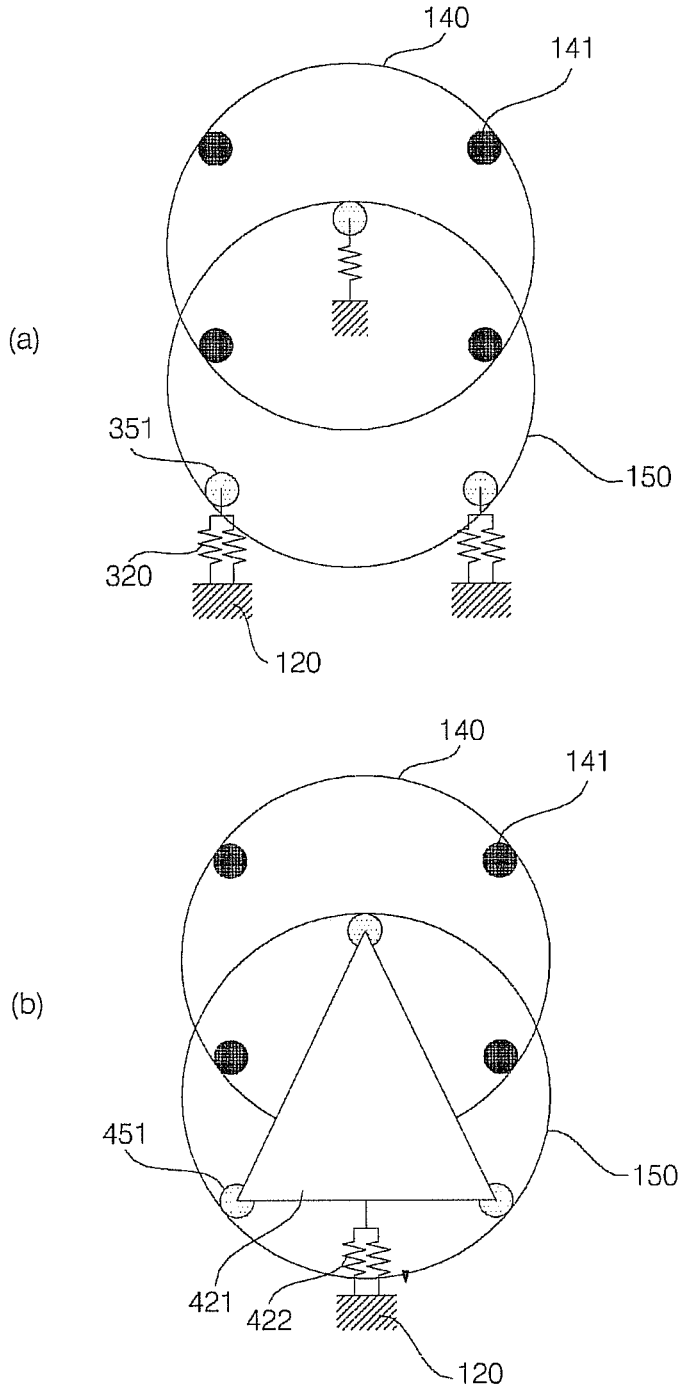
FIG. 14 is a schematic view showing inter-shaft distance controller of a laundry treating apparatus according to another exemplary embodiment of the present invention.

FIG. 14 is a schematic view showing inter-shaft distance controller of a laundry treating apparatus according to another exemplary embodiment of the present invention.

Referring to (a) of FIG. 14, inter-shaft distance adjusters 320 in the exemplary embodiment are elastic members connecting lower support rollers 351 supporting the lower circular guide 150 with the panel 120. A plurality of inter-shaft distance adjusters 320 is provided and connected to the lower support rollers 351, respectively.

Referring to (b) of FIG. 14, an inter-shaft distance adjuster 420 in the exemplary embodiment includes a movable panel 421 where lower support rollers 451 supporting the lower circular guide 150 are rotatably disposed, and distance-adjusting elastic body 422 having elasticity and connecting the movable panel 421 with the panel 120.

A plurality of lower support rollers 451 is rotatably coupled to the movable panel 421. The movable panel 421 is connected with the panel 120 by the distance-adjusting elastic member 422 such that it can be relatively moved from the panel 120 by an elastic force.

Figure 15:
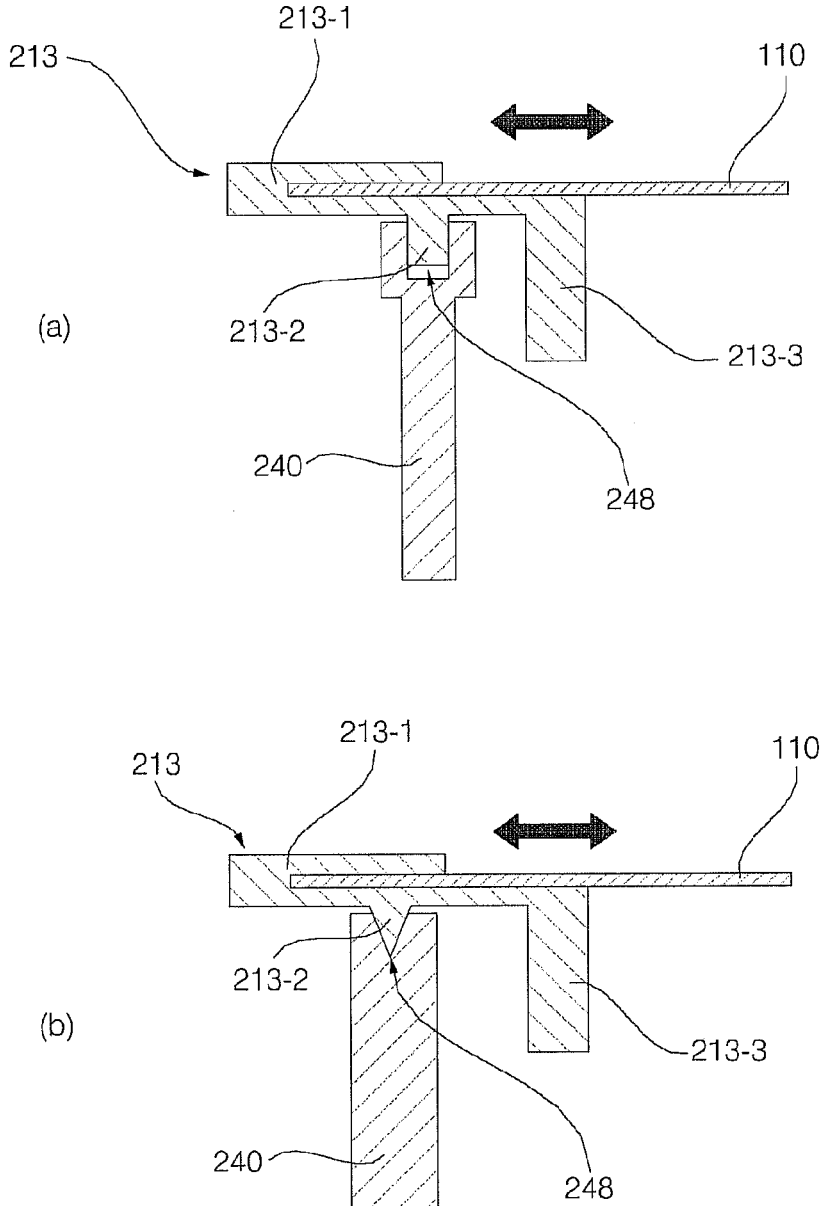
FIG. 15 is a view partially showing the configuration of a drum guide of a laundry treating apparatus according to another exemplary embodiment of the present invention.

FIG. 15 is a view partially showing the configuration of a drum guide of a laundry treating apparatus according to another exemplary embodiment of the present invention.

A drum guide 312 according to another exemplary embodiment of the present invention has a drum guide edge 213-1 covering the edge of the drum 110, a first drum guide protrusion 213-2 protruding inside the drum 110, and a second drum guide protrusion 213-3 protruding inside the drum 110 at a predetermined distance from the first drum guide protrusion 113-2. Further, an upper circular guide 240 according to another exemplary embodiment of the present invention has a circular guide groove 248 recessed on the outer side. The first drum guide protrusion 213-2 is partially inserted in the circular guide groove 248.

Referring to (a) of FIG. 15, the first drum guide protrusion 213-2 has a uniform width and the circular guide groove 248 is a groove with a uniform width corresponding to the width of the first drum guide protrusion.

Referring to (b) of FIG. 15, the first drum guide protrusion 213-2 narrows toward the end with a wedge-shaped cross-section and the circular guide groove 248 is a groove narrowing with the increase in depth to correspond to the first drum guide protrusion.

The exemplary embodiment may be applied to the lower circular guide 250 as well as the upper circular guide 240.

Figure 16:
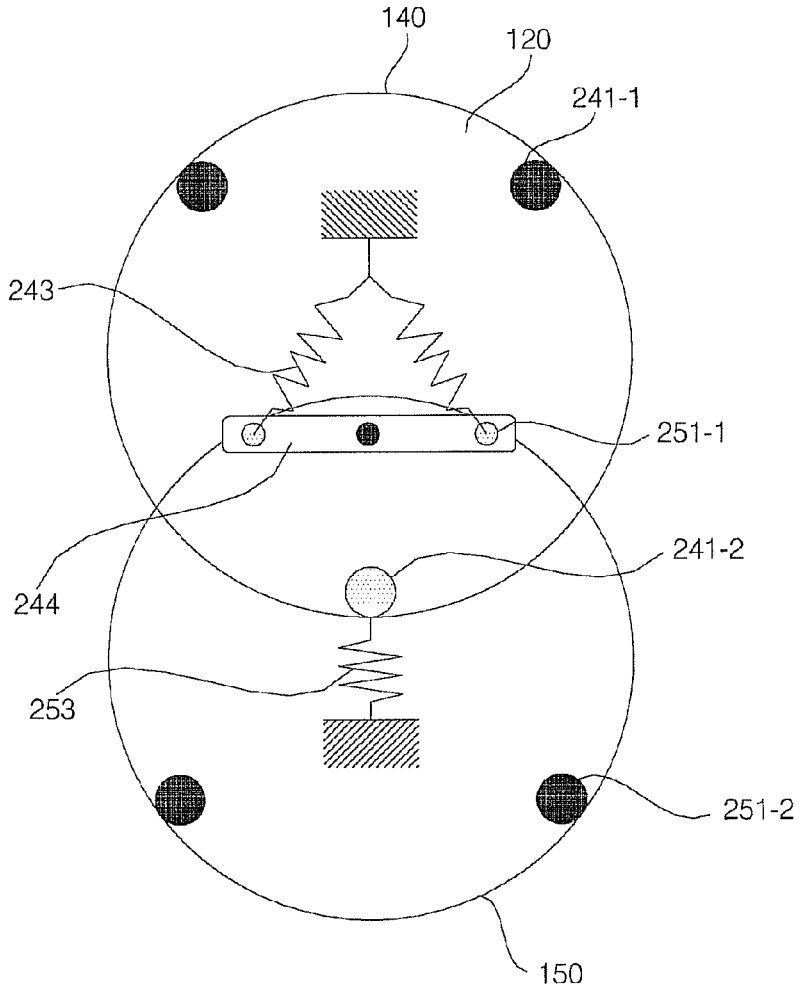
FIG. 16 is a view partially showing the structure of a circular guide of a laundry treating apparatus according to another exemplary embodiment of the present invention.

FIG. 16 is a view partially showing the structure of a circular guide of a laundry treating apparatus according to another exemplary embodiment of the present invention.

A laundry treating apparatus according to another exemplary embodiment of the present invention includes upper support roller elastic bodies 243 elastically connect at least one of a plurality of upper support rollers 241 with the panel 120, and a lower support roller elastic body 253 elastically connecting at least one of a plurality of lower support rollers 251 with the panel 120.

The upper support roller elastic bodies 243 and the lower support roller elastic body 253 can change the distance from the rotational center of the upper circular guide 140 to the rotational center of the lower circular guide 150.

It is preferable that the upper-upper support roller 241-1 of the upper support rollers 241 is rotatably coupled with the rotary shaft fixed to the panel 120 and the lower-upper support roller 241-2 is connected with the panel 120 by the upper support roller elastic bodies 243.

Further, it is preferable that the lower-lower support roller 251-2 of the lower support rollers 251 is rotatably coupled with the rotary shaft fixed to the panel 120 and the upper-lower support roller 251-1 is connected with the panel 120 by the lower support roller elastic bodies 253.

The upper support roller 243 or the lower support roller 251 connected with the panel 120 by the upper support roller elastic bodies 243 or the lower support roller elastic body 253 may be rotatably coupled with the rotary shaft fixed to a sub-panel 244, depending on exemplary embodiments. That is, the lower-upper support roller 241-2 or the upper-lower support roller 251-1 may be rotatably fixed to the sub-panel 244. It is preferable the sub-panel 244 is rotatably coupled to the panel 120.

Further, the upper support rollers 241 or the lower support rollers 251 may be coupled with the rotary shafts fixed to the sub-panel 244 and the sub-panel 244 may be elastically connected with the panel 120 by the upper support roller elastic bodies 243 or the lower support roller elastic body 253, depending on exemplary embodiments. In this case, it is also preferable the sub-panel 244 is rotatably coupled to the panel 120.

It is preferable that the upper support roller elastic bodies 243 or the lower support roller elastic bodies 253 is a torsion spring or an extension spring.

Figure 17:
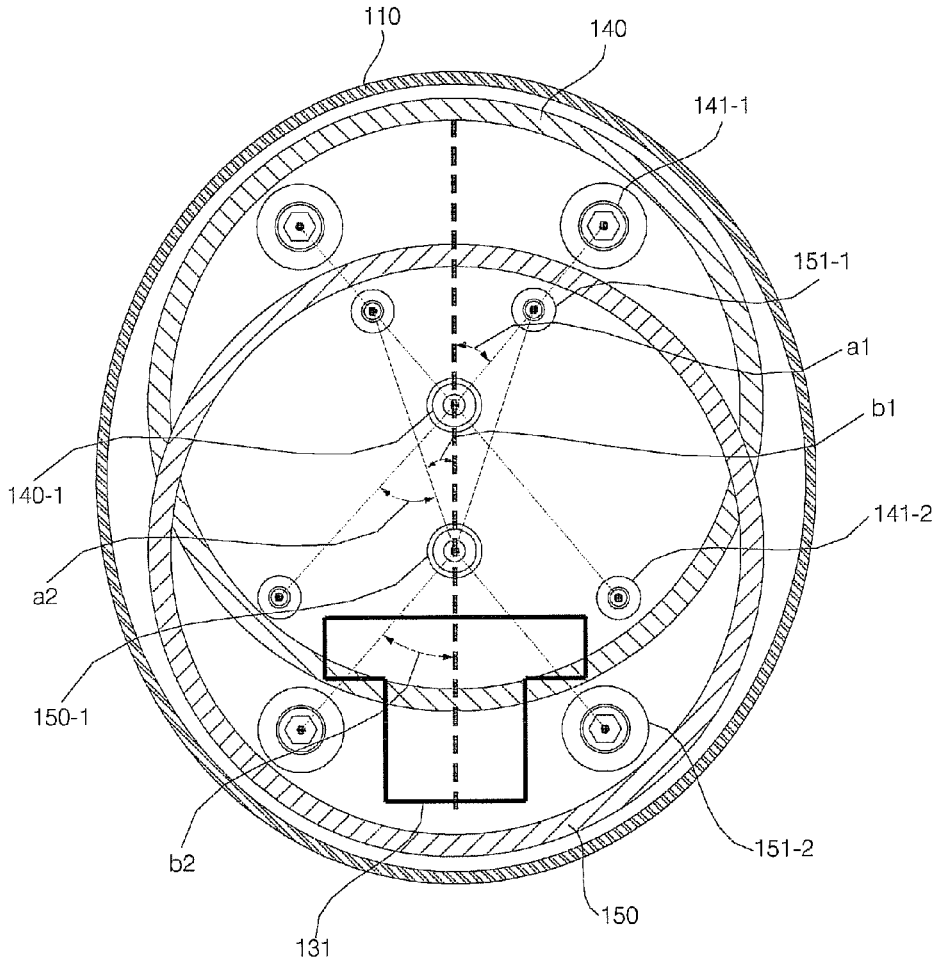
FIG. 17 is a view showing arrangement of rollers in the laundry treating apparatus according to an exemplary embodiment of the present invention.
Figure 18:
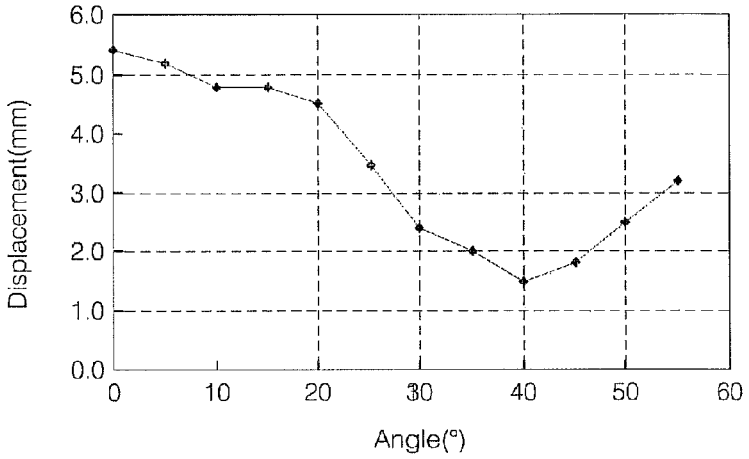
FIG. 18 is a graph showing vibration according to the arrangement of rollers in the laundry treating apparatus according to an exemplary embodiment of the present invention.
Figure 18:
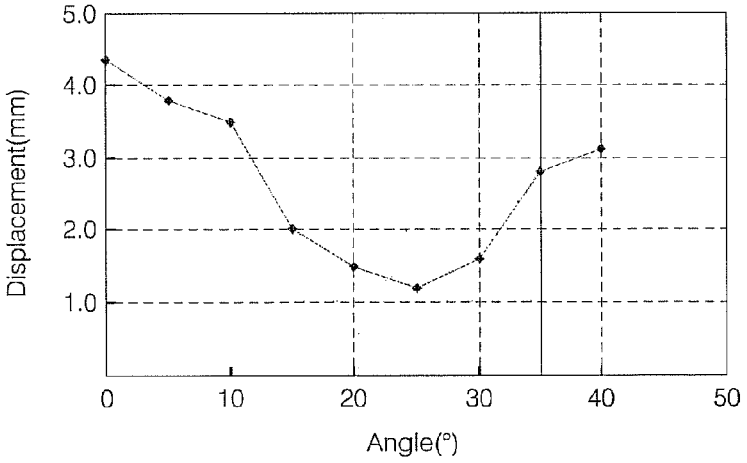

FIG. 17 is a view showing arrangement of rollers in the laundry treating apparatus according to an exemplary embodiment of the present invention. FIG. 18 is a graph showing vibration according to the arrangement of rollers in the laundry treating apparatus according to an exemplary embodiment of the present invention.

With respect to the vertical line on the rotational center of the upper circular guide 140, the angle made by the upper-upper support roller 141-1 is a1 and the angle made by the lower-upper support roller 141-2 is a2. Further, with respect to the vertical line on the rotational center of the lower circular guide 150, the angle made by the upper-lower support roller 151-1 is b1 and the angle made by the lower-lower support roller 151-2 is b2.

The two lower-upper support rollers 141-1 are spaced from each other to avoid the suction duct 131. The lower-upper support rollers 141-2 should avoid the upper portion of the suction duct 131 and the upper portion of the suction duct 131 should correspond to the first discharge hole 128 formed through the side of the lower portion of the panel protrusion 124, such that the two lower-upper support rollers 141-2 are spaced from each other, avoiding the first discharge hole 128. It is preferable that a2 is 50±10° in the exemplary embodiment such that the two lower-upper support rollers 141-2 avoid the suction duct 131.

The two lower-lower support rollers 151-2 are spaced from each other to avoid the suction duct 131. The lower-lower support rollers 151-2 should avoid the lower portion of the suction duct 131 and the lower portion of the suction duct 131 should correspond to the second discharge hole 129 formed at the lower portion of the front panel 120*a*, such that the two lower-lower support rollers 151-2 are spaced from each other, avoiding the second discharge hole 129.

The two lower-lower support rollers 151-2 avoid the upper circular guide 140. Since the two lower-lower support rollers 151-2 are disposed between the lower portion of the upper circular guide 140 and the lower portion of the lower circular guide 150, the two lower-lower support rollers 151-2 may be interfered with the lower portion of the upper circular guide 140, when they are spaced too much from each other. Therefore, it is preferable that the two lower-lower support rollers 151-2 are appropriately spaced from each other, avoiding the upper circular guide 140.

It is preferable that b2 is 40±10° in the exemplary embodiment such that the two lower-lower support rollers 151-2 avoid the suction duct 131 and the upper circular guide 140.

It is preferable that the two lower-upper support rollers 141-2 are spaced from each other further than the two lower-lower support rollers 151-2. That is, a2>b2 is preferable.

The two upper-upper support rollers 141-1 are spaced from each other such that vibration of the drum is small. (a) of FIG. 18 shows front-rear, that is, axial vibration values of the drum 110 according to a1. The axial vibration of the drum 110 should be within 3 mm to prevent the drum 110 from separating, such that it is preferable that a1 is 40±10°.

The upper-lower support rollers 151-1 are spaced from each other such that vibration of the drum is small. (b) of FIG. 18 shows front-rear, that is, axial vibration values of the drum 110 according to b1. The axial vibration of the drum 110 should be within 3 mm to prevent the drum 110 from separating, such that it is preferable that a2 is 25±10°.

It is preferable that the two upper-upper support rollers 141-1 are spaced from each other further than the two upper-lower support rollers 151-1. That is, a1>b1 is preferable.

It is preferable that the two lower-upper support rollers 141-2 are spaced from each other further than the two upper-upper support rollers 141-1. That is, a2>a1 is preferable. The line connecting the centers of the two lower-upper support rollers 141-2 and the two upper-upper support rollers 141-1 constructs a trapezoid with the lower base longer than the upper base.

It is preferable that the two lower-lower support rollers 151-2 are spaced from each other further than the two upper-lower support rollers 151-1. That is, b2>b1 is preferable. The line connecting the centers of the two lower-lower support rollers 151-2 and the two upper-lower support rollers 151-1 constructs a trapezoid with the lower base longer than the upper base.

Figure 19:
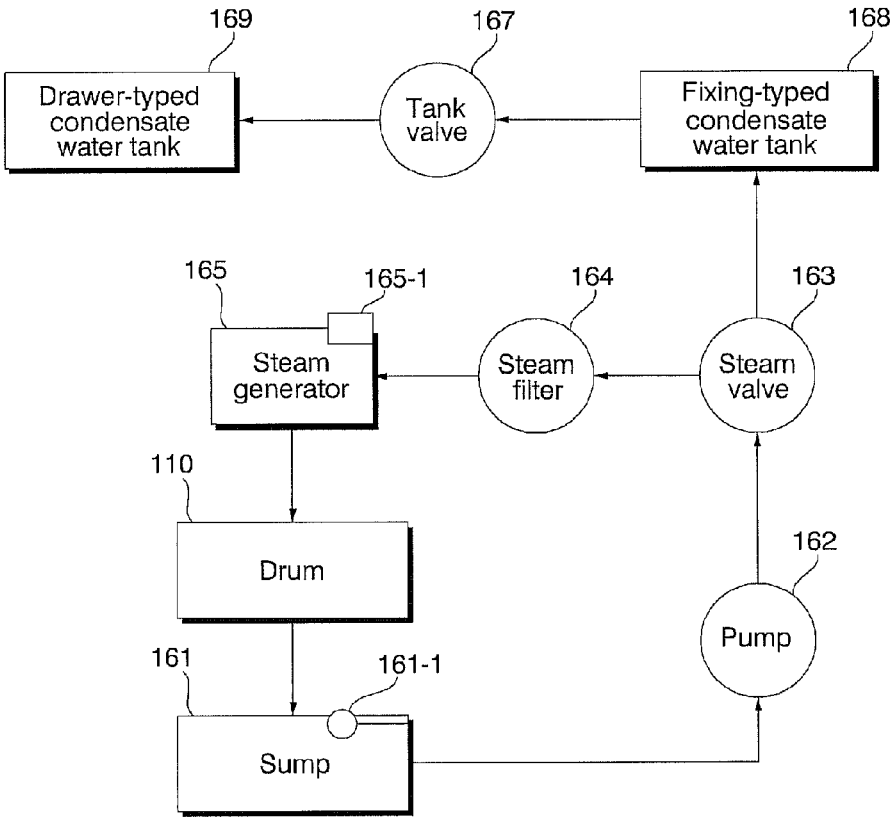
FIG. 19 is a schematic view showing the flow of condensate water in the laundry treating apparatus according to an exemplary embodiment of the present invention.

FIG. 19 is a schematic view showing the flow of condensate water in the laundry treating apparatus according to an exemplary embodiment of the present invention.

A sump 161 collects condensate water produced from the drum 110. The sump 161 is disposed under the drum 110, or in the suction duct 131 or the discharge duct 133. It is preferable that the sump 161 is connected with the suction duct 131 or the discharge duct 133 and collects not condensate water produced directly from the drum 110, but condensate water that is produced in a vapor state from the drum 110 and condensed through the suction duct 131 or the discharge duct 133.

The sump 161 may be equipped with a sump water level sensor 161-1 that measures the level of the condensate water collected in the sump 161. The sump water level sensor 161-1 is composed of a buoy and a strain gauge and measures the water level with the strain gauge detecting the buoy moving in accordance with the water level.

The condensate water collected in the sump 161 is pumped by a pump 162. The pump 162 pumps up and sends the condensate water collected in the sump 161 to a fixing-typed condensate water tank 168 under pressure. It is preferable that the pump 162 operates, when the water level measured by the sump water level sensor 161-1 is a reference sump water level or more.

A steam generator 165 supplies steam to the drum 110. The steam generator 165 receives the condensate water collected in the sump 161, produces steam by heating the condensate water, and supplies the steam to the drum 110. The steam generator 165 may be replaced by a sprayer that sprays to the drum 110, depending on exemplary embodiments.

The steam generator 165 includes a steam water level sensor 165-1 that senses the level of the condensate water in the steam generator 165. It is preferable that the steam water level sensor 165-1 measures the water level in the steam generator 165, using an electrode.

A steam valve 163 guides the condensate water collected in the sump 161 to the steam generator 165 or the fixing-typed condensate water tank 168. The steam valve 163, a 3-way valve, guides the condensate water pumped up by the pump 162 to the steam generator 165 or the fixing-typed condensate water tank 168.

A steam filter 164 may be disposed between the steam valve 163 and the steam generator 165. The steam filter 164 removes foreign substances by filtering the condensate water flowing to the steam generator 165 from the steam valve 163.

When the water level measured by the steam water level sensor 165-1 is a reference steam water level or less, the steam valve 163 guides the condensate water collected in the sump 161 to the steam generator 165. However, when the water level measured by the steam water level sensor 165-1 is a reference steam water level or more, the steam valve 163 guides the condensate water collected in the sump 161 to the fixing-typed condensate water tank 168.

A tank valve 167 is disposed between the fixing-typed condensate water tank 168 and the drawer-typed condensate water tank 169. The tank valve 167 prevents the condensate water in the fixing-typed condensate water tank 168 from leaking to the drawer-typed condensate water tank 169 when the drawer-typed condensate water tank 169 is drawn out. The tank valve 167 is mounted on the drawer-typed condensate water tank 169, and is opened when the drawer-typed condensate water tank 169 is in the cabinet 101 and closed when the drawer-typed condensate water tank 169 is drawn out.

Although exemplary embodiments of the present invention are illustrated and described above, the present invention is not limited to the specific exemplary embodiments and may be modified in various ways by those skilled in the art without departing from the scope of the present invention described in claims, and the modified examples should not be construed independently from the spirit of the scope of the present invention.

According to a laundry treating apparatus of an exemplary embodiment of the present invention, one or more effects can be achieved as follows.

There is an advantage that a plurality of circular guides support a drum such that the drum can rotate with a non-circular closed cross-section maintained.

There is another advantage that the drum can rotate with the non-circular closed cross-section maintained, because the circular guides rotate with the drum while carrying the load of the drum.

There is another advantage that the air in the drum is smoothly discharged by efficiently sealing the drum rotating with the non-circular closed cross-section maintained.

There is another advantage that it is possible to prevent the drum from separating from the circular guide due to vibration of the drum.

The effects of the present invention are not limited to those described above and other effects not stated herein may be made apparent to those skilled in the art from claims.

What is claimed is:

1. A laundry treating apparatus comprising:

a flexible rotatable drum that receives laundry, has an open front and an open rear, and is formed to have a non-circular closed cross-section;

a rotatable upper circular guide that is arranged with a rotational center higher than a rotational center of the drum and supports an upper portion of the drum having a uniform curvature;

a rotatable lower circular guide that is arranged with a rotational center lower than the rotational center of the drum and supports a lower portion of the drum having a uniform curvature; and a drum guide provided on the edge of the drum that seals the portion between the upper and lower circular guides and the drum.

2. The apparatus of claim 1, wherein the drum guide has a drum guide edge covering the edge of the drum, a first drum guide protrusion bending from the portion covering the inner side of the drum, at the edge of the drum guide, and protruding inside the drum, and a second drum guide protrusion extending from the first drum guide protrusion and protruding inside the drum.

3. The apparatus of claim 2, wherein the drum guide edge is in contact with the outer side of the upper and lower circular guide, and a side of the first drum guide protrusion is in contact with a portion of a side of the upper and lower circular guide.

4. The apparatus of claim 2, wherein the each of upper and lower circular guide has a circular guide groove recessed on the outer side, and the first drum guide protrusion is partially inserted in the circular guide groove.

5. The apparatus of claim 2, further comprising:

a panel provided ahead of or behind, the drum and supporting the upper and lower circular guides; and a panel sealer provided on the panel and having a side in contact with a side of the second drum guide protrusion.

6. The apparatus of claim 5, further including a panel bracket coupled to the panel and supporting the panel sealer, wherein the panel sealer is provided between the panel bracket and the second drum guide protrusion.

7. The apparatus of claim 6, wherein the panel bracket is formed in a non-circular rim shape with an inner side protruding toward the panel and coupled to the panel and an outer side coupled to the panel sealer.

8. The apparatus of claim 5, wherein the second drum guide protrusion is provided between the panel and the panel sealer.

9. The apparatus of claim 5, wherein the panel sealer is formed in a non-circular rim shape.

10. The apparatus of claim 2, further including:

a panel provided ahead of or behind the drum and supporting the upper and lower circular guides; and a panel sealer provided on the panel and having a side in contact with a side of the second drum guide protrusion.

11. The apparatus of claim 10, further including a panel bracket coupled to the panel and supporting the panel sealer, wherein the panel sealer is provided between the panel bracket and the second drum guide protrusion.

12. The apparatus of claim 11, wherein the panel bracket is formed in a non-circular rim shape with an inner side protruding toward the panel and coupled to the panel and an outer side coupled to the panel sealer.

13. The apparatus of claim 10, wherein the second drum guide protrusion is provided between the panel and the panel sealer.

14. The apparatus of claim 10, wherein the panel sealer is formed in a non-circular rim shape.

15. The apparatus of claim 1, wherein the drum guide is in contact with a portion of a side of the upper and lower circular guides to prevent the drum from separating from the upper and lower circular guide.

16. A laundry treating apparatus comprising;

a flexible rotatable drum that receives laundry, has an open front and an open rear, and is formed to have a non-circular closed cross-section;

a rotatable upper circular guide that is arranged with a rotational center higher than a rotational center of the drum and supports a portion having a uniform curvature at the upper portion of the drum;

a rotatable lower circular guide that is arranged with a rotational center lower than the rotational center of the drum and supports a portion having a uniform curvature at the lower portion of the drum; and a drum guide that is provided at an edge of the drum in partial contact with an outer side and a side of the upper circular guide and in contact with the outer side of the lower circular guide.

17. A laundry tread ng apparatus comprising:

a flexible rotatable drum that receives laundry, has an open front and an open rear, and is formed to have a non-circular closed cross-section;

a rotatable upper circular guide that supports an upper portion of the drum having a uniform curvature;

a rotatable lower circular guide that supports a lower portion of the drum having a uniform curvature; and a drum guide that is disposed on the edge of the drum and seals the portion between the circular guide and the drum, wherein the drum guide has a drum guide edge covering the edge of the drum, a first drum guide protrusion bending from the portion covering the inner side of the drum, at the edge of the drum guide, and protruding inside the drum, and a second drum guide protrusion extending from the first drum guide protrusion and protruding inside the drum.

18. The apparatus of claim 17, wherein the drum guide edge is in contact with the outer side of the upper and lower circular guide, and a side of the first drum guide protrusion is in contact with a portion of a side of the upper and lower circular guide.

19. The apparatus of claim 17, wherein the each of upper and lower circular guide has a circular guide groove recessed on the outer side, and the first drum guide protrusion is partially inserted in the circular guide groove.

20. The apparatus of claim 17, wherein the drum guide is in contact with a portion of a side of the upper and lower circular guides to prevent the drum from separating from the upper and lower circular guide.

* * * * *